US010385677B2

(12) United States Patent
Gzara et al.

(10) Patent No.: US 10,385,677 B2
(45) Date of Patent: Aug. 20, 2019

(54) FORMATION VOLUMETRIC EVALUATION USING NORMALIZED DIFFERENTIAL DATA

(71) Applicant: Schlumberger Technology Corporation, Sugar Land, TX (US)

(72) Inventors: Kais Gzara, Tunis (TN); Vikas Jain, Sugar Land, TX (US); Alan Patrick Hibler, Al-Khobar (SA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 1027 days.

(21) Appl. No.: 13/837,409

(22) Filed: Mar. 15, 2013

(65) Prior Publication Data

US 2013/0338926 A1 Dec. 19, 2013

Related U.S. Application Data

(60) Provisional application No. 61/620,750, filed on Apr. 5, 2012.

(51) Int. Cl.
*E21B 47/00* (2012.01)
*E21B 43/00* (2006.01)

(52) U.S. Cl.
CPC ..... *E21B 47/0003* (2013.01); *E21B 43/00* (2013.01)

(58) Field of Classification Search
CPC ..... E21B 47/0003; E21B 43/00; E21B 43/20; E21B 47/12; E21B 49/008; G01V 1/30;
(Continued)

(56) References Cited

U.S. PATENT DOCUMENTS 3,993,903 A 11/1976 Neuman
4,459,480 A 7/1984 Dimon
(Continued)

FOREIGN PATENT DOCUMENTS

CN 1896458 1/2007
EP 0539118 A2 4/1993
(Continued)

OTHER PUBLICATIONS

Clarke, Robert. "The properties of high-dimensional data spaces: implications for exploring gene and protein expression data". naturere views, cancer vol. 8 Jan. 2008 pp. 37-49.*
(Continued)

*Primary Examiner* — Yoshihisa Ishizuka

(57) ABSTRACT

A method for determining volumetric data for fluid within a geological formation is provided. The method includes collecting first and second dataset snapshots of the geological formation based upon measurements from the borehole at respective different first and second times and generating a differential dataset based upon the first and second dataset snapshots. Multiple points are determined within the differential dataset, including a first point representing a first displaced fluid, a second point representing a second displaced fluid, and an injected fluid point that corresponds to properties of the injected fluid. A further third point is determined based on at least one other property of the displaced fluid, and a volumetric composition of the displaced fluids is determined based upon the differential dataset, the first point, and second point, and third point.

15 Claims, 13 Drawing Sheets

(58) Field of Classification Search
CPC ..... G01V 1/32; G01V 2210/48; G01V 2210/645; G01V 2210/66; G01V 2210/661
USPC ..... 702/8
See application file for complete search history.

(56) References Cited

U.S. PATENT DOCUMENTS

| | | | | |
|---|---|---|---|---|
| 5,428,293 | A | 6/1995 | Sinclair et al. | |
| 6,216,532 | B1 | 4/2001 | Stephenson et al. | |
| 7,453,766 | B1 | 11/2008 | Padgett | |
| 7,523,002 | B2 | 4/2009 | Griffiths | |
| 7,555,390 | B2 | 6/2009 | Ramakrishnan | |
| 2002/0134587 | A1* | 9/2002 | Rester | E21B 47/10 175/48 |
| 2004/0055745 | A1* | 3/2004 | Georgi | E21B 49/00 166/250.02 |
| 2006/0253759 | A1 | 11/2006 | Wei | |
| 2007/0120051 | A1 | 5/2007 | DiFoggio et al. | |
| 2008/0015784 | A1 | 1/2008 | Dorn et al. | |
| 2009/0026359 | A1 | 1/2009 | Stephenson et al. | |
| 2009/0177403 | A1 | 7/2009 | Gzara | |
| 2009/0210161 | A1* | 8/2009 | Duenckel | G01V 5/101 702/8 |
| 2010/0243246 | A1* | 9/2010 | Ayirala | E21B 43/20 166/266 |
| 2010/0264915 | A1* | 10/2010 | Saldungaray | E21B 43/16 324/303 |
| 2011/0042097 | A1* | 2/2011 | Stephenson | E21B 17/18 166/369 |
| 2011/0066380 | A1* | 3/2011 | Hager | E21B 41/0064 702/8 |
| 2011/0088895 | A1* | 4/2011 | Pop | E21B 7/04 166/254.2 |
| 2011/0181701 | A1* | 7/2011 | Varslot | G06T 7/0026 348/46 |
| 2011/0189778 | A1* | 8/2011 | Daniel | H01J 49/145 436/25 |
| 2011/0284227 | A1* | 11/2011 | Ayan | E21B 43/16 166/307 |
| 2012/0068060 | A1 | 3/2012 | Chace et al. | |
| 2012/0143579 | A1* | 6/2012 | Collins | E21B 43/16 703/10 |
| 2012/0234535 | A1* | 9/2012 | Dawson | E21B 43/16 166/263 |
| 2013/0047717 | A1 | 2/2013 | Gzara | |

FOREIGN PATENT DOCUMENTS

| | | | |
|---|---|---|---|
| EP | 2348337 | A1 | 7/2011 |
| WO | 2011086145 | A1 | 7/2011 |
| WO | 2011119911 | A2 | 9/2011 |

OTHER PUBLICATIONS

Mathisfun. "https://web.archive.org/web/20090905145533/http://www.mathsisfun.com/algebra/line-equation-point-slope.html", Sep. 5, 2009.*

Hamsici, Onur. "Spherical-Homoscedastic Distributions: The Equivalency of Spherical and Normal Distributions in Classification". Journal of Machine Learning Research 8 (2007) 1583-1623.*

International Preliminary Report on Patentability and the Written Opinion for International Application No. PCT/US2013/035296 dated Oct. 16, 2014.

Supplementary Search Report R.61 or R.63 EPC issued in corresponding European application 134772183 dated Sep. 15, 2015, 3 pages.

Examination Report 94(3) EPC issued in corresponding European application 134772183 dated Oct. 2, 2015. 5 pages.

International Search Report and Written Opinion for International Application No. PCT/US2013/035292 dated Jul. 18, 2013.

International Preliminary Report on Patentability for International Application No. PCT/US2013/035292 dated Oct. 7, 2014.

First Office Action issued in Chinese application 201380029585.3 dated Apr. 25, 2016. 24 pages including English Translation.

Supplementary Search Report. R.61 or R.63 EPC, issued in corresponding European application 13772513 dated Oct. 2, 2015. 4 pages.

Decision to Grant 97(1) EPC, issued in corresponding European application 13772513 dated Apr. 29, 2016. 4 pages.

International Search Report and Written Opinion for International Application No. PCT/US2013/035296 dated Jul. 7, 2013.

Fournier et al., "A Statistical Methodology for Deriving Reservoir Properties from Seismic Data," Geophysics, Society of Exploration Geophysics, US, vol. 60, No. 5, Sep. 1, 1995, pp. 1437-1450.

Khadija at al., "How a Small Difference Can Make a Big Difference in Understanding Complex Fluids," SPWLA 54th Annual Logging Symposium, Jun. 26, 2016 15 pages.

Office Action 34045 issued in Mexican Patent Application MX/a/2014/012041 dated Apr. 26, 2017, 3 page.

Second Office Action issued in Chinese Patent Application No. 201380029585.3 dated Dec. 26, 2016, 39 pages.

Examination Report under 94(3) EPC issued in European Patent Application No. 134772183 dated Feb. 24, 2017, 8 pages.

Office Action issued in Mexican Patent Application No. MX/a/2014/012042 dated Apr. 26, 2017, 2 pages.

Office Action issued in U.S. Appl. No. 13/836,651 dated Jul. 6, 2016, 26 pages.

Office Action issued in U.S. Appl. No. 13/836,651 dated Dec. 1, 2016, 23 pages.

Chen, Fuxuan, Interpretation of Resistivity Time-Lapse Logging, Natural Gas Industry, No. 1, vol. 16, Jan. 31, 1996, pp. 25-28.

Fu, Junjua et al., The Application of Time-Lapsed CBL in Cased Hole to the Identification of Gas Reservoir and Mud Filtrate Invasion, Geophysical and Geochemical Exploration, No. 3, vol. 26, Jun. 30, 2002, pp. 203-206.

Wang, Zhizhang et al., Variation Rule and Mechanism of Reservoir Parameters in the Middle and Later Stages of Development, Beijing Petroleum Industry Press, Oct. 31, 1999, pp. 62-64.

Wei, Zhongliang et al., Geophysical Well Logging, Beijing Geological Press, Aug. 31, 2005, pp. 343-345.

First Office Action issued in Chinese Patent Application No. 201380029177.8 dated Nov. 2, 2016, 10 pages.

Second Office Action issued in Chinese Patent Application No. 201380029177.8 dated Jun. 30, 2017, 6 pages.

* cited by examiner

FORMATION VOLUMETRIC EVALUATION USING NORMALIZED DIFFERENTIAL DATA

CROSS-REFERENCE TO RELATED APPLICATION(S)

This application claims priority to and the benefit of U.S. Provisional Patent Application Ser. No. 61/620,750, filed Apr. 5, 2012, entitled "Methods of Formation Evaluation for In-Situ Characterization of Formation Constituents," the disclosure of which is hereby incorporated by reference in its entirety.

BACKGROUND

Logging tools may be used in wellbores to make, for example, formation evaluation measurements to infer properties of the formations surrounding the borehole and the fluids in the formations. Common logging tools include electromagnetic tools, acoustic tools, nuclear tools, and nuclear magnetic resonance (NMR) tools, though various other tool types are also used.

Early logging tools were run into a wellbore on a wireline cable, after the wellbore had been drilled. Modern versions of such wireline (WL) tools are still used extensively. However, the need for real-time or near real-time information while drilling the borehole gave rise to measurement-while-drilling (MWD) tools and logging-while-drilling (LWD) tools. By collecting and processing such information during the drilling process, the driller may modify or correct key steps of the well operations to optimize drilling performance and/or well trajectory.

MWD tools typically provide drilling parameter information such as weight-on-bit, torque, shock and vibration, temperature, pressure, rotations-per-minute (rpm), mud flow rate, direction, and inclination. LWD tools typically provide formation evaluation measurements such as natural or spectral gamma ray, resistivity, dielectric, sonic velocity, density, photoelectric factor, neutron porosity, sigma thermal neutron capture cross-section ($\Sigma$), a variety of neutron induced gamma ray spectra, and NMR distributions. MWD and LWD tools often have components common to wireline tools (e.g., transmitting and receiving antennas or sensors in general), but MWD and LWD tools may be constructed to not only endure but to operate in the harsh environment of drilling. The terms MWD and LWD are often used interchangeably, and the use of either term in this disclosure will be understood to include both the collection of formation and wellbore information, as well as data on movement and placement of the drilling assembly.

Logging tools may be used to determine formation volumetrics, that is, quantify the volumetric fraction, usually expressed as a percentage, of each and every constituent present in a given sample of formation under study. Formation volumetrics involves the identification of the constituents present, and the assigning of unique signatures for constituents on different log measurements. When, using a corresponding earth model, all of the forward model responses of the individual constituents are calibrated, the log measurements may be converted to volumetric fractions of constituents.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A method for determining volumetric data for fluid within a geological formation having a borehole therein may include collecting first and second dataset snapshots of the geological formation based upon measurements from the borehole at respective different first and second times, and with the borehole subject to fluid injection between the first and second times to displace fluid in the geological formation adjacent the borehole. The method may further include generating a differential dataset based upon the first and second dataset snapshots, normalizing the differential dataset to generate a normalized differential dataset, and determining vertices defining a geometric shape and corresponding to respective different displaced fluid signatures based upon the normalized differential dataset. The method may also include determining a first line passing through a first point representing a first displaced fluid with known first properties, and directed along a corresponding first vertex, determining a second line passing through a second point representing a second displaced fluid with known second properties, and directed along a corresponding second vertex, determining an injected fluid point corresponding to the properties of the injected fluid based upon an intersection of the first line and the second line, and determining another line passing through the injected fluid point and directed along another vertex corresponding to another displaced fluid with unknown properties. The method may additionally include determining a third point along the other line based upon at least one known property of the other displaced fluid, and determining a volumetric composition of the displaced fluids based upon the differential dataset, the first point, the second point, and the third point.

A related well-logging system and non-transitory computer-readable medium are also provided.

DETAILED DESCRIPTION

The present description is made with reference to the accompanying drawings, in which example embodiments are shown. However, many different embodiments may be used, and thus the description should not be construed as limited to the embodiments set forth herein. Rather, these embodiments are provided so that this disclosure will be thorough and complete. Like numbers refer to like elements throughout.

Figure 1:
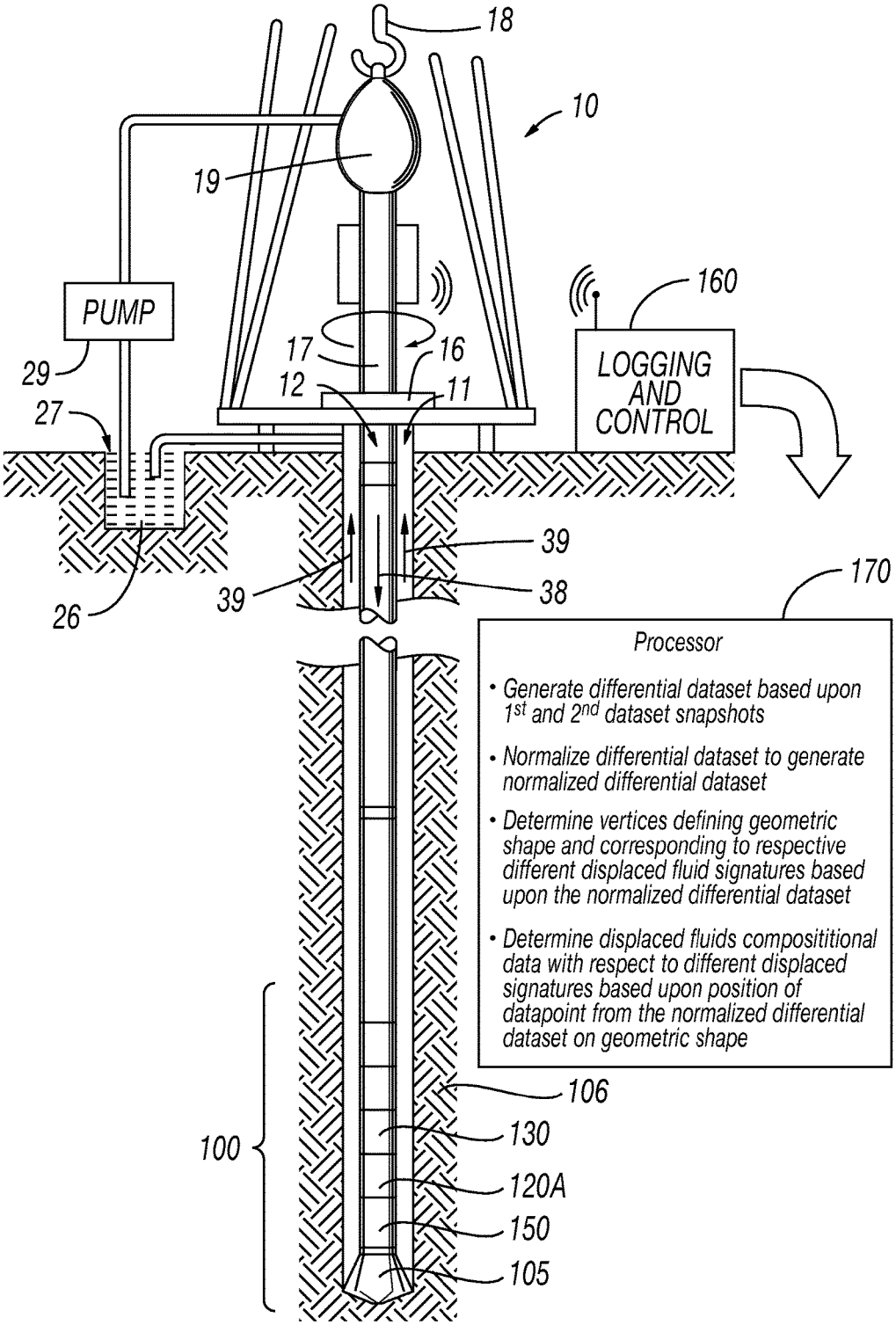
FIG. 1 is a schematic diagram of a well site system which may be used for implementation of an example embodiment.

Referring initially to FIG. 1, a well site system which may be used for implementation of the example embodiments set forth herein is first described. The well site may be onshore or offshore. In this exemplary system, a borehole 11 is formed in subsurface formations 106 by rotary drilling. Embodiments of the disclosure may also use directional drilling, for example.

A drill string 12 is suspended within the borehole 11 and has a bottom hole assembly 100 which includes a drill bit 105 at its lower end. The surface system includes a platform and derrick assembly 10 positioned over the borehole 11, the assembly 10 including a rotary table 16, Kelly 17, hook 18 and rotary swivel 19. The drill string 12 is rotated by the rotary table 16, which engages the Kelly 17 at the upper end of the drill string. The drill string 12 is suspended from a hook 18, attached to a travelling block (not shown), through the Kelly 17 and a rotary swivel 19 which permits rotation of the drill string relative to the hook. A top drive system may also be used in some embodiments.

In the illustrated example, the surface system further illustratively includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 38. The drilling fluid exits the drill string 12 via ports in the drill bit 105, and then circulates upwardly through the annulus region between the outside of the drill string and the wall of the borehole 11, as indicated by the directional arrows 39. The drilling fluid lubricates the drill bit 105 and carries formation 106 cuttings up to the surface as it is returned to the pit 27 for recirculation.

In various embodiments, the systems and methods disclosed herein may be used with other conveyance approaches known to those of ordinary skill in the art. For example, the systems and methods disclosed herein may be used with tools or other electronics conveyed by wireline, slickline, drill pipe conveyance, coiled tubing drilling, and/or a while-drilling conveyance interface. For the purpose of an example only, FIG. 1 shows a while-drilling interface. However, systems and methods disclosed herein could apply equally to wireline or other suitable conveyance platforms. The bottom hole assembly 100 of the illustrated embodiment includes a logging-while-drilling (LWD) module 120, a measuring-while-drilling (MWD) module 130, a rotary-steerable system and motor, and drill bit 105.

The LWD module 120 is housed in a drill collar and may include one or a more types of logging tools. It will also be understood that more than one LWD and/or MWD module may be used, e.g. as represented at 120A. (References, throughout, to a module at the position of 120 may alternatively mean a module at the position of 120A as well.) The LWD module may include capabilities for measuring, processing, and storing information, as well as for communicating with the surface equipment, such as the illustrated logging and control station 160. By way of example, the LWD module may include one or more of an electromagnetic device, acoustic device, nuclear magnetic resonance device, nuclear measurement device (e.g. gamma ray, density, photoelectric factor, sigma thermal neutron capture cross-section, neutron porosity), etc., although other measurement devices may also be used.

The MWD module 130 is also housed in a drill collar and may include one or more devices for measuring characteristics of the drill string and drill bit. The MWD tool may further include an apparatus for generating electrical power to the downhole system (not shown). This may typically include a mud turbine generator powered by the flow of the drilling fluid, it being understood that other power and/or battery systems may be employed. The MWD module may also include one or more of the following types of measuring devices: a weight-on-bit measuring device, a torque measuring device, a shock and vibration measuring device, a temperature measuring device, a pressure measuring device, a rotations-per-minute measuring device, a mud flow rate measuring device, a direction measuring device, and an inclination measuring device.

The above-described borehole tools may be used for collecting measurements of the geological formation adjacent the borehole 11 to determine one or more characteristics of the fluids being displaced within the geological formation 106 in accordance with example embodiments. A processor 170 may be provided for determining such characteristics. The processor 170 may be implemented using a combination of hardware (e.g., microprocessor, etc.) and a non-transitory medium having computer-executable instructions for performing the various operations described herein. It should be noted that the processor 170 may be located at the well site, or it may be remotely located.

By way of background, one of the objectives of formation evaluation (FE) is formation volumetrics, i.e., the quantification of the percentage volumetric fraction of each constituent present in a given sample of formation under study. At the heart of formation volumetrics is the identification of the constituents present, and the corresponding geological model (sometimes also called an "earth model"). The constituents are assigned a signature on different log measurements, and log measurements selected are typically optimized to ensure a unique signature per the constituents present. In general, practical considerations such as technology, operating conditions (well geometry, hole size, mud-type, open vs. cased hole, temperature, etc.), HSE aspects, and economics may restrict the log measurements contemplated. Moreover, homogeneous medium "mixing laws" are selected based on the intrinsic physics of the measurements selected, and three-dimensional geometrical response functions are selected based on the specific tool type and design carrying out the measurement. Considered together, formation constituents log measurement signatures, mixing-laws and the geometrical response functions allow the forward-modeling of various log measurements responses for a constituents' mixture, and forward-model inversion may then convert log measurements back into constituents' volumetric fractions.

In particular, the operations of identifying and assigning a log signature to the different constituents present (at in-situ conditions) may be a challenge, especially when working with WL logs with relatively shallow depth of investigation, in the presence of relatively deep depth of invasion in the case of conventional over-balance drilling, although LWD measurements acquired prior to invasion may have already progressed too deep inside the formation and/or under-balance drilling may be used to alleviate these WL specific concerns. However, whereas identifying the different constituents present may be remedied to some extent through various operations, assigning a unique signature to the different constituents present does not always have an easy solution. This may be due to several factors.

For example, the analysis of rock cuttings brought back to the surface during the drilling process and/or mud logging operations may generally provide geologists and petrophysicists with significant and early clues (referred to here as "ground truth") as to the identity of the different constituents present, with certain exceptions (depending on drilling mud type). Optional coring operations (which may potentially be costly and impractical) go a step further, to cut and retrieve many feet of formation whole core for further detailed analysis on surface. Also, downhole advanced elemental spectroscopy logging techniques (e.g., thermal neutron capture spectroscopy logs, fast neutron inelastic scattering spectroscopy logs, elemental neutron activation spectroscopy logs, etc.) may all help account for the matrix constituents, and reduce the formation volumetrics challenge down to just fluid elemental volumetric fractions.

Furthermore, optional formation testing operations (e.g., pressure gradients, downhole fluid analysis, fluid sampling, etc.), despite the limited availability of such station data at discrete depth points along the well, may be considered to test the producible fluid constituents of the formation. Also, recently introduced advanced multi-dimensional NMR logging techniques may help tell different fluid constituents apart from each other.

A prerequisite to assigning a signature to a particular constituent is that a quantitative volume (or mass) of it be separated and isolated from the other constituents, either literally or virtually via mathematical analysis. Measurements made on such a sample may then be normalized to the quantity of constituents present, and log signatures derived. It should be noted that even when samples are retrieved at the surface, surface instruments to perform measurement analogs to the various downhole logs may not be readily available or possible, and even so, measurements carried out at the surface need to be further extrapolated to downhole pressure and temperature conditions.

A systematic approach is provided herein to identify and calibrate some of the formation constituents log responses, from log measurements alone. That is, rather than to look for the signature of individual constituents present at one time at one depth, the present approach may instead look for the patterns resulting from cross-constituent (x-constituent) substitution when the substitution occurs in pairs (i.e., when one constituent "I" replaces another constituent "J", all other things remaining equal). This effectively amounts to benchmarking one constituent against another, and where one of the constituents log response(s) is fully understood, the log response(s) of the other one may be reconstructed.

Figure 2:
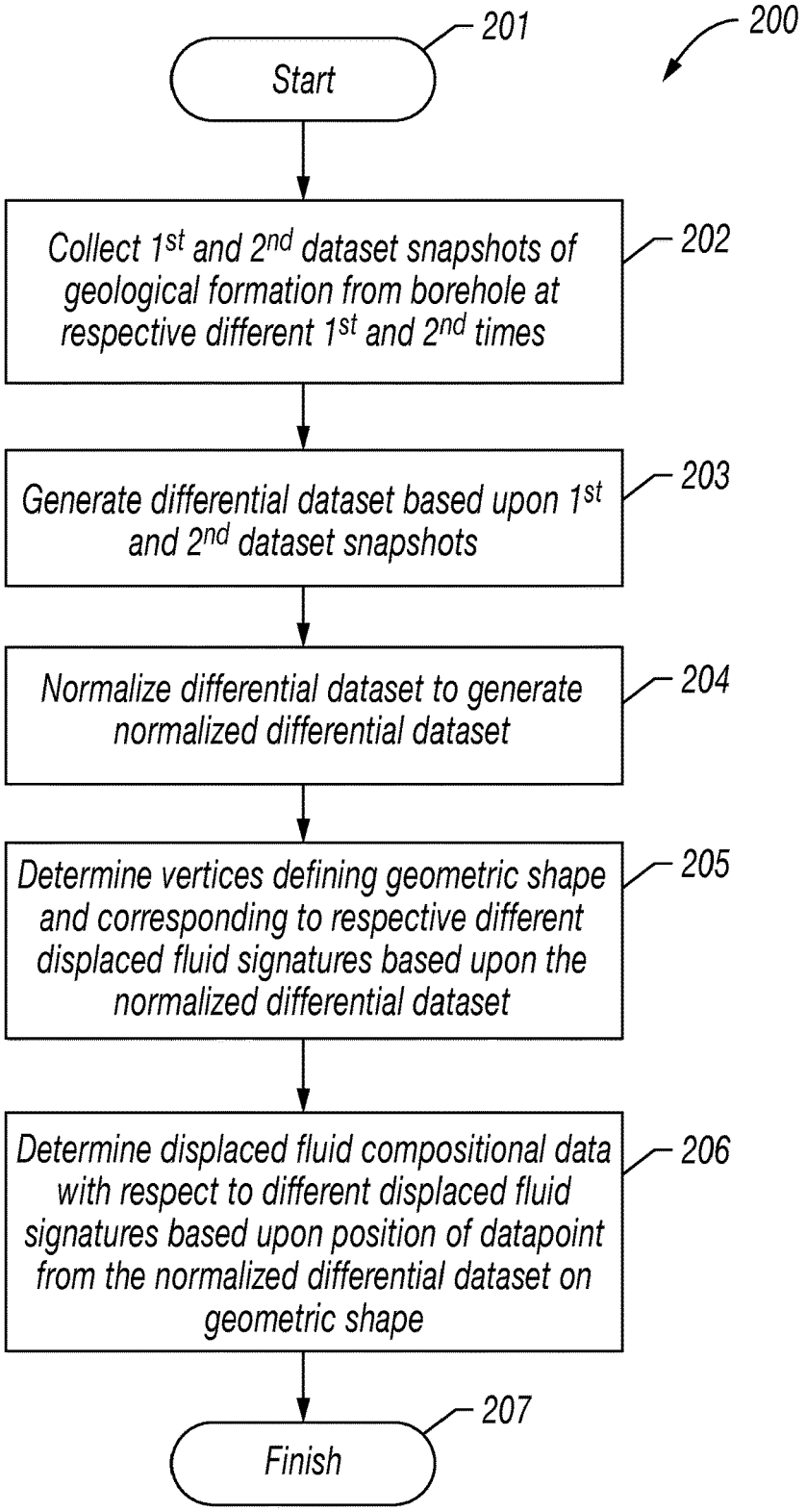
FIGS. 2, 3A, and 3B are flow diagrams illustrating formation evaluation operations in accordance with example embodiments.

One example implementation for determining compositional data for fluids within the geological formation 106 is first generally described with reference to the flow diagram 200 of FIG. 2. Beginning at Block 201, the method illustratively includes collecting first and second dataset snapshots based upon measurements of the geological formation 106 from the borehole 11 at respective different first and second times, and with the borehole subject to fluid injection between the first and second times to displace moveable fluids in the geological formation adjacent the borehole, at Block 202. By way of example, the fluid injection may include various types of enhanced oil recovery (EOR) fluids, such as fresh water, carbon dioxide, etc. The method may further include generating a differential dataset based upon the first and second dataset snapshots, at Block 203, and normalizing the differential dataset to generate a normalized differential dataset, at Block 204, as will be described further below. The method also illustratively includes determining vertices defining a geometric shape and corresponding to respective different displaced fluid signatures based upon the normalized differential dataset, at Block 205, and determining displaced fluid compositional data with respect to the different displaced fluid signatures based upon a position of a datapoint from the second dataset on the geometric shape, at Block 206, as will also be described in further detail below. The method illustratively concludes at Block 207.

More particularly, the present approach utilizes effectively consonant measurements. That is, either truly consonant, or virtually consonant by processing techniques such as invasion correction techniques, or because the measurements read in the same type of formation although actual volumes of investigation may be different. Such as, this may occur when the measurements are simultaneously in a situation where they are affected little by invasion, or in a situation where they are all overwhelmed by invasion. These measurements are used to probe the same formation twice or more, where changes in formation composition are expected in-between the different probes or snapshots. This allows for a characterization of the change(s) that have taken place. It should be noted that the measurements need only be consonant among each other, for the same snapshot. Measurements from one snapshot vs. measurements from another snapshot need not be consonant.

While it may initially seem as if the problem would grow more complex that way, this is not necessarily the case. For example, for "Z" constituents present, there would be "Z(Z−1)" constituent pair exchanges possible (which is much larger than Z), but in nature and in practice, only a very small number of such pair exchanges will be relevant to the case at hand. By way of example, present day native fluid distribution inside a reservoir, as a result of fluid migration and substitution over a geological time scale, and relative permeability increase with the saturation of the corresponding fluid, are such that at a given depth only one of the native fluids in place is predominantly moveable. That is, the others will have already been displaced. Further, the intrusive fluid disturbing this original reservoir balance (or equilibrium fluid distribution) is usually well defined, being either injected from the surface or produced to the surface.

On the other hand, it is typically difficult to directly isolate the signature of individual fluid constituents, because they may not be present on their own, or they may not be available in a sufficient amount, in the volume of formation under investigation, despite the reservoir balance discussed above. This is typically the case with over-balance drilling, and is exacerbated by conventional WL logging. Should under-balance drilling be considered instead, or should the log measurements considered be suited for existing invasion correction techniques (such as per the method described in US Pat. Pub. No. 2009/0177403 to Gzara, which is hereby incorporated herein in its entirety by reference), then the situation would be different, and one type of fluid constituent may indeed overwhelm all the others. However, even in this situation, the lack of information on the precise quantity of fluid constituent present would ordinarily represent an impediment to derive the signature of that fluid, although this may be overcome by the approach set forth herein, as will be discussed further below.

Furthermore, when studying the patterns resulting from x-constituent substitution, the other constituents manifestly do not play a role, which reduces the complexity that would otherwise result from trying to solve for the multitude of constituents log measurements signatures all at once. There is, however, a special case where the x-constituent substitution does not necessarily exactly occur in pairs, but where the concepts set forth herein may still apply and be adapted. This special case is that of underground formations with variable water salinity, typically resulting from water injection operations to maintain reservoir pressure and sustain hydrocarbon production. Here, the injected water salinity differs substantially from the original formation water (also called "connate" water) salinity, and the mixture of the two in different proportions across the reservoir results in different water salinity. The substituted fluids in this case may be interpreted as a mixture of connate formation water, injection water, and unswept hydrocarbons.

This present approach may also apply to a wide range of situations, depending on the many possible origins of the observed changes in formation composition between the different snapshots. Indeed, the observed changes may be the result of displaced fluids, displaced fines, phase changes (such as initiated by pressure or temperature changes), or chemical reactions in general including dissolution or precipitation (such as asphaltene(s) precipitation, scale deposition, salt dissolution, acid stimulation, etc.), or eventually changes in compaction or pressure or stress regimes in general.

Generally speaking, such changes may fall in various categories. The first category is changes with time (e.g., when the same volume of formation is probed at different times, the first time being typically referred to as a "base log"). With regard to injection-induced changes, these may include: small time scale, invasion dynamics (drill pass vs. wipe pass); small time scale, reservoir stimulation techniques (such as invasion coupled with chemical reaction dynamics, or solvent injection); small time scale, log-inject-log (LiL) techniques in general (i.e. multiple invasion cycles, with fit-for-purpose invading fluids); and large time scale, reservoir monitoring (such as with injector wells). With regard to production induced changes, these may include small time scale, under balance drilling, or pressure induced changes (such as gas expansion, condensate banking, gas coming out of solution, gas coning, water coning, or thief zones); and large time scale, reservoir monitoring (such as with producer wells). Further changes are "thermo-mechanical setting" induced changes, which may include: small time scale, temperature induced changes (such as thawing and melting of ice or hydrates); large time scale, temperature induced changes (such as touched up heavy oil properties, when thermal recovery techniques are used); and large time scale, stress-induced changes.

The next category includes changes with radial depth (e.g., when deeper and deeper volumes of the same formation are probed at just one time), which requires different sets of consonant measurements among one another for each of the deeper and deeper volumes investigated. With regard to injection induced changes, these may include: small time scale, invasion dynamics (drill pass vs. wipe pass); small time scale, reservoir stimulation techniques (such as invasion coupled with chemical reaction dynamics, or solvent injection); small time scale, LiL techniques in general (e.g., multiple invasion cycles with fit-for-purpose invading fluids). Regarding production induced changes, these may include small time scale, under balance drilling, and pressure induced changes (such as condensate banking, or gas coming out of solution). With respect to overall "setting" induced changes, these may include small time scale, temperature induced changes (such as thawing and melting of ice or hydrates).

Still another category includes changes in-between zones (i.e., changes with depth), where one same constituent is present and takes part in all the foreseen x-constituent pair substitutions. This is a somewhat counter-intuitive case, applicable solely when the presence of the same constituent across different zones can be ascertained with relative confidence. In this case, the measurements made at a given depth are benchmarked against the hypothetical situation where the same constituent occupies the entire volume of the formation, which is how the technique may be extended to this case. Even when the nature of that same constituent is only known approximately, the mere fact that we are in the presence of the same constituent is sufficient for the technique to work. In practice, the same rock mineralogy may be differentiated based on downhole log data that responds primarily to the rocks and minerals only, such as (but not limited to) advanced elemental capture spectroscopy, or natural gamma ray log data. It may also be differentiated based on surface observations, such as (but not limited to) core data in general, and mud logging data and the analysis of cuttings in particular. Alternatively, the same fluid type may be differentiated based on downhole log data that responds primarily to the fluids only, such as formation testing log data. It may also be differentiated based on surface observations, such as (but not limited to) produced fluids analysis in general, and more particularly mud logging data and the analysis of drilling mud returns. Or it may also be ascertained simply because it may be injected from surface, such as (but not limited to) drilling mud filtrate in the case of under balance drilling.

Where the rock mineralogy may be positively discriminated, then changes in fluid type may be recognized, and where changes in fluid type are also accompanied by notable variation(s) in porosity, then the end-points of the rock mineralogy concerned can be calibrated in-situ. Where the fluid composition may be instead positively discriminated, then changes in rock mineralogy may be recognized, and where changes in rock mineralogy are also accompanied by notable variation(s) in porosity, then the end-points of the fluid type concerned can be calibrated in-situ. Various combinations of the foregoing may also be used.

It should be noted that the disciplines of production logging or drilling optimization, as compared to formation evaluation, are focused on the contents of the borehole itself during production or injection or during drilling, as opposed to the constituents of the formation. Some of the concepts described herein may be transposed to the field of production logging or drilling optimization (such as hole cleaning and kick detection), for example, as will be appreciated by those skilled in the art.

In accordance with a first aspect, an approach to identify and classify the changes that have taken place is described. Vector notation $\vec{M}$ corresponding to the effectively consonant measurements considered $m_1\ m_2 \ldots m_\alpha\ m_\beta \ldots m_n$ is used, and the description will refer to the different snapshots of the formation as $\vec{M}^1\ \vec{M}^2 \ldots \vec{M}^i\ \vec{M}^j \ldots \vec{M}^N$, whereas the different formation constituents log signatures will be referred to as $\vec{M}_A\ \vec{M}_B \ldots \vec{M}_I\ \vec{M}_J \ldots \vec{M}_Z$. Furthermore, $\vec{M}$ is generically meant to represent $\vec{M}$ itself, or any linear transformation thereof. Where the volume and log responses of some constituents are known a priori, the notation $\vec{M}$ will also include such transformations that rid $\vec{M}$ of these known constituents' contributions to produce a "clean" $\vec{M}$ vector that only depends on the remaining unknowns alone.

In this description, these vectors may be alternatively displayed as curves over "n" datapoints, taking on the values $m_1\ m_2 \ldots m_\alpha\ m_\beta \ldots m_n$, in which case the vector notation may be dropped and substituted with the function notation $\tilde{M}^1\ \tilde{M}^2 \ldots \tilde{M}^i\ \tilde{M}^j \ldots \tilde{M}^N$ and $\tilde{M}_A\ \tilde{M}_B \ldots \tilde{M}_I\ \tilde{M}_J \ldots \tilde{M}_Z$. This is how NMR multi-component data is typically displayed, and the term "distribution(s)" has been coined in reference to the associated curves. In this description, the measurements $m_1\ m_2 \ldots m_\alpha\ m_\beta \ldots m_n$ are also taken to be unitless (or dimensionless) by normalizing all the measurements to the quantum of noise inherently pervading each. First, this is helpful to remain above the noise level intrinsic to various measurements, and to avoid confounding noise with true information. Second, this is helpful when it comes to displaying the above discussed vectors or functions, on a neutral or user-independent scale. It should be noted that this measurement normalization is different from other normalizations introduced later, such as signature pseudo-normalization, and signature true normalization.

Changes in $\vec{M}$ between snapshots "i" and "j" may then be expressed as a linear combination of all vectors $(\vec{M}_J-\vec{M}_I)$ as follows (assuming measurements with linear mixing laws):

$$\begin{cases} \vec{M}^j = \sum_I V_I^j \cdot \vec{M}_I \\ \vec{M}^i = \sum_I V_I^i \cdot \vec{M}_I \end{cases}$$

$$\Delta_{ij}(\vec{M}) = \vec{M}^j - \vec{M}^i = \sum_I \Delta_{ij}(V_I) \cdot \vec{M}_I = \sum_{All\ [I,J]\ pairs} \left\{ \frac{(V_J^j - V_J^i) - (V_I^j - V_I^i)}{Z} \right\} \cdot \left(\vec{M}_J - \vec{M}_I\right)$$

keeping in mind that this expression is not unique, as the vectors $(\vec{M}_J-\vec{M}_I)$ are interdependent. A more familiar expression follows, in case of constituent "I" and "J" only pair exchange:

$$\Delta_{ij}(\vec{M})=\Delta_{ij}(V_J)\cdot(\vec{M}_J-\vec{M}_I)=\Delta_{ij}(V_I)\cdot(\vec{M}_I-\vec{M}_J)$$

Figure 4:
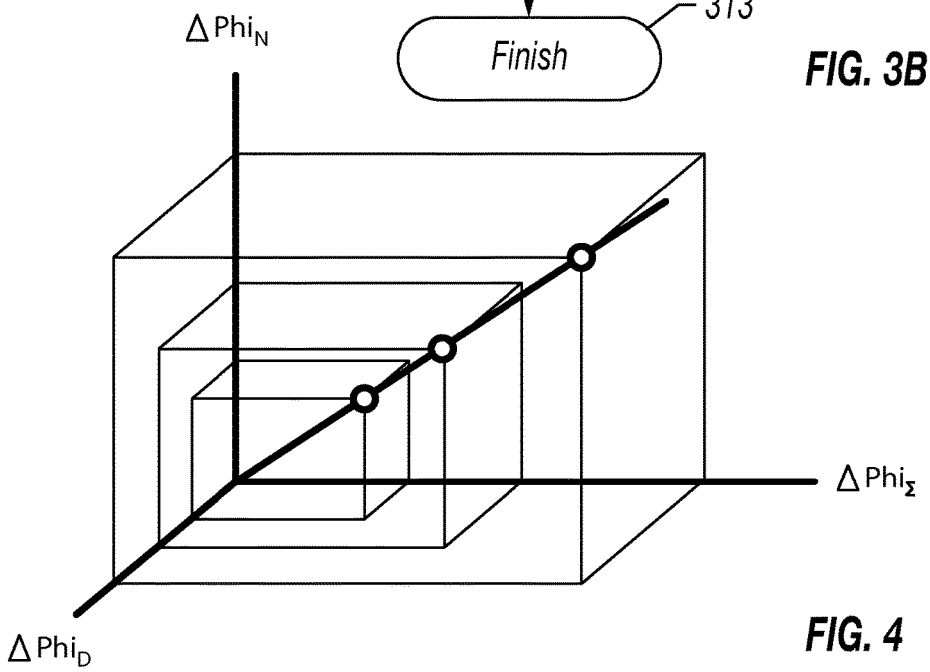
FIG. 4 is a three-dimensional (3D) graph of data points corresponding to a single pair of constituents substituting one another through fluid displacement.

FIG. 4 displays the relationship $\Delta_{ij}(\vec{M})=\Delta_{ij}(V_J)\cdot(\vec{M}_J-\vec{M}_I)=\Delta_{ij}(V_I)\cdot(\vec{M}_I-\vec{M}_J)$ for a single pair of constituents "I" and "J" substituting each other, in the instance where M represents the three log measurements $Phi_N$ (apparent neutron porosity), $Phi_D$ (apparent density porosity), and $Phi_\Sigma$ (apparent Σ porosity). Namely, it shows that as $\Delta_{ij}(V_I)$ changes, the datapoints $\Delta_{ij}(\vec{M})$ remain aligned (along the vector $(\vec{M}_I-\vec{M}_J)$).

Figure 5:
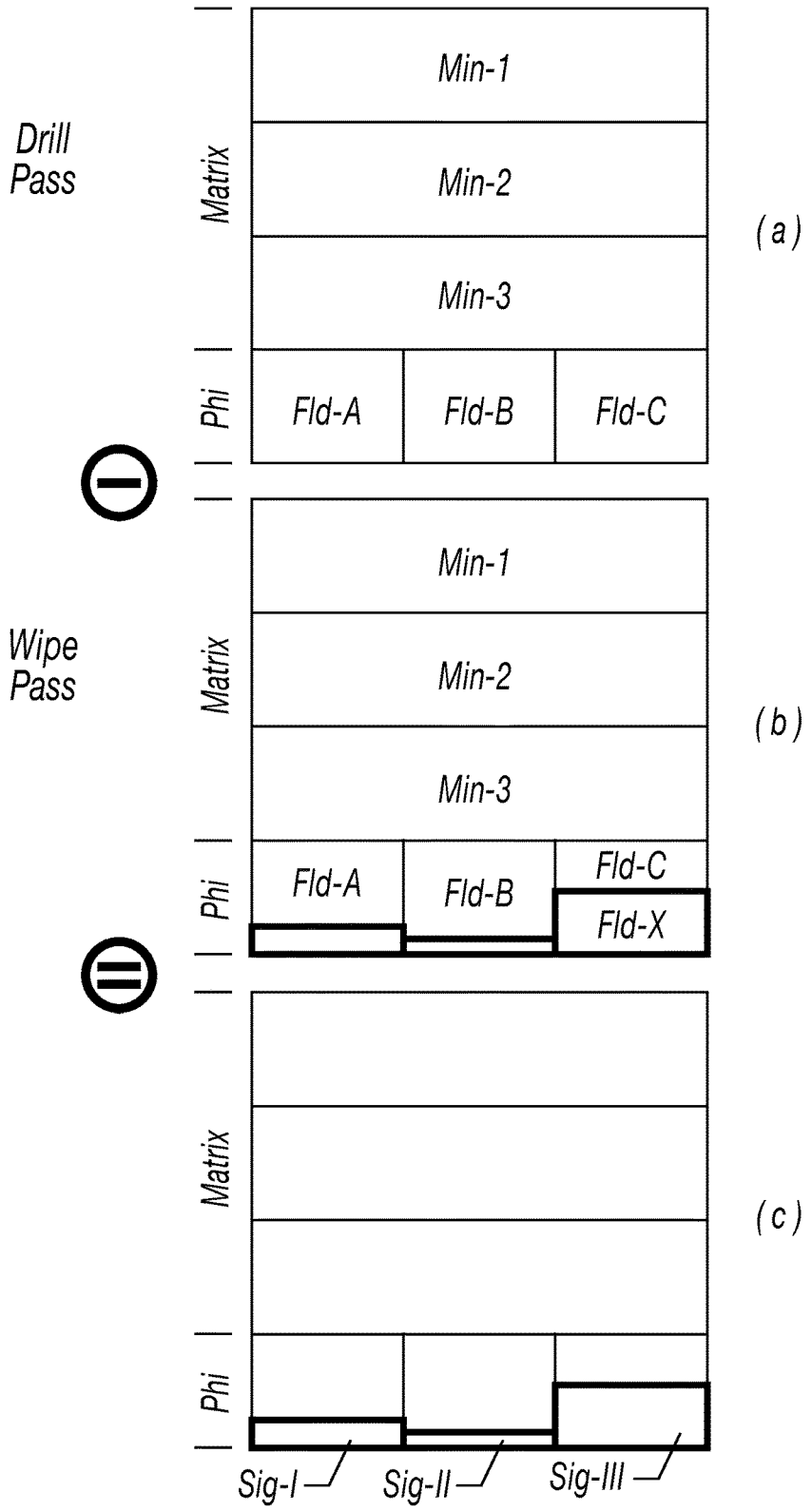
FIG. 5 is a schematic diagram illustrating the determination of a differential data set from time-lapse geological formation snapshots.

The benefits of taking the difference $(\vec{M}^j-\vec{M}^i)$ may also be represented in an example now discussed with reference to FIG. 5, which illustrates the process corresponding to subtracting the drill and wipe passes from each other in the context of drilling mud filtrate invasion during overbalance drilling. The upper part "(a)" of the figure shows the volumetric distribution of minerals (Min-1, Min-2, and Min-3) making-up the matrix (- -Matrix- -), and of fluids (Fld-A, Fld-B, and Fld-C) filling up the pore space (-Phi-) inside the volume of investigation of the LWD measurements considered, during the drill pass. In this case, the LWD measurements from the drill pass are considered a linear combination of the same measurements' responses corresponding to each of these mineral and fluid constituents present, as weighted by their respective volumetric proportions.

The second (middle) part "(b)" of the figure shows the volumetric distribution of minerals (Min-1, Min-2, and Min-3) making-up the matrix (- -Matrix- -), and another fluid (Fld-X) alongside the original native fluids (Fld-A, Fld-B, and Fld-C) filling up the same pore space (-Phi-) inside the volume of investigation of the LWD measurements considered, during the wipe pass. Fluid Fld-X (e.g., injected drilling mud filtrate) represents a new fluid that was not originally present inside the pore space, and that now occupies pore space which was originally occupied by fluids Fld-A, Fld-B, and Fld-C. Here again, the LWD measurements from the wipe pass are considered a linear combination of the same measurements' responses corresponding to each of these constituents present, as weighted by their respective volumetric proportions. Note that in the example, the volumetric distribution of minerals does not change in-between the drill and wipe pass.

The last (lower) part "(c)" of the figure shows the volumetric distribution corresponding to the difference (i.e., differential dataset) between the drill and wipe pass measurements. Note that the matrix minerals (and anything else that does not move in-between the drill and wipe passes) cancel out. Again, the difference in-between LWD measurements from the drill and wipe pass are considered a linear combination of signatures, which now do not correspond to individual constituents present, but rather the signature of pairs of constituents cross-substituting each other (Sig-I, Sig-II, Sig-III). That is, this is the log measurements signature of one of the constituents less the signature of the other, as weighted by the respectively displaced volume.

Figure 6:
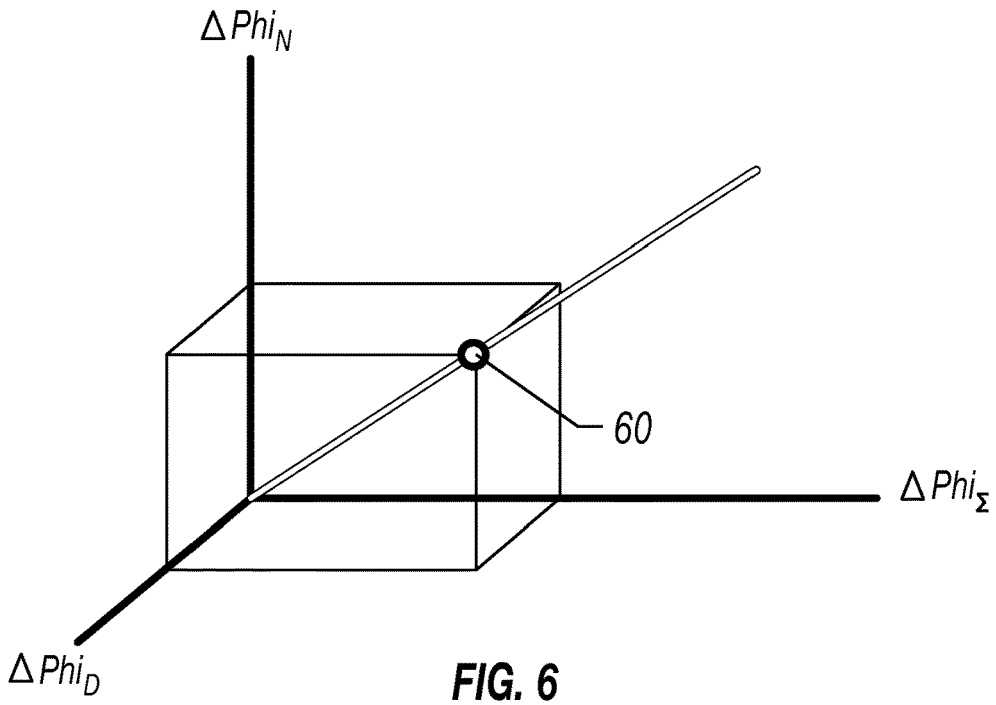
FIGS. 6-9 are 3D graphs illustrating fluid displacement signatures for the differential dataset of FIG. 5.
Figure 7:
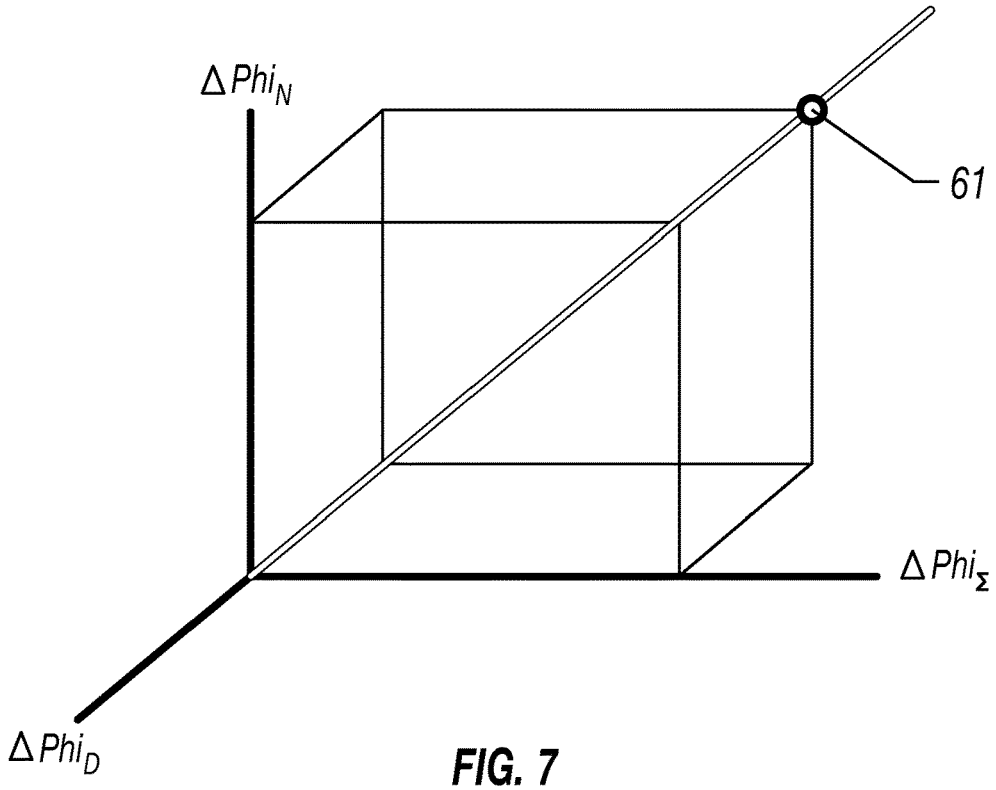
Figure 8:
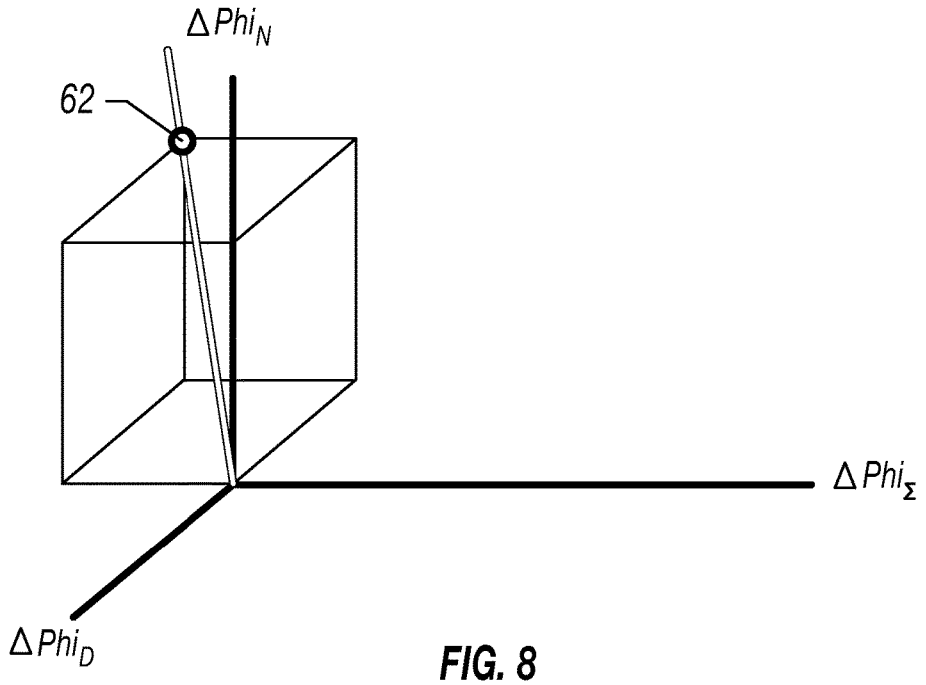
Figure 9:
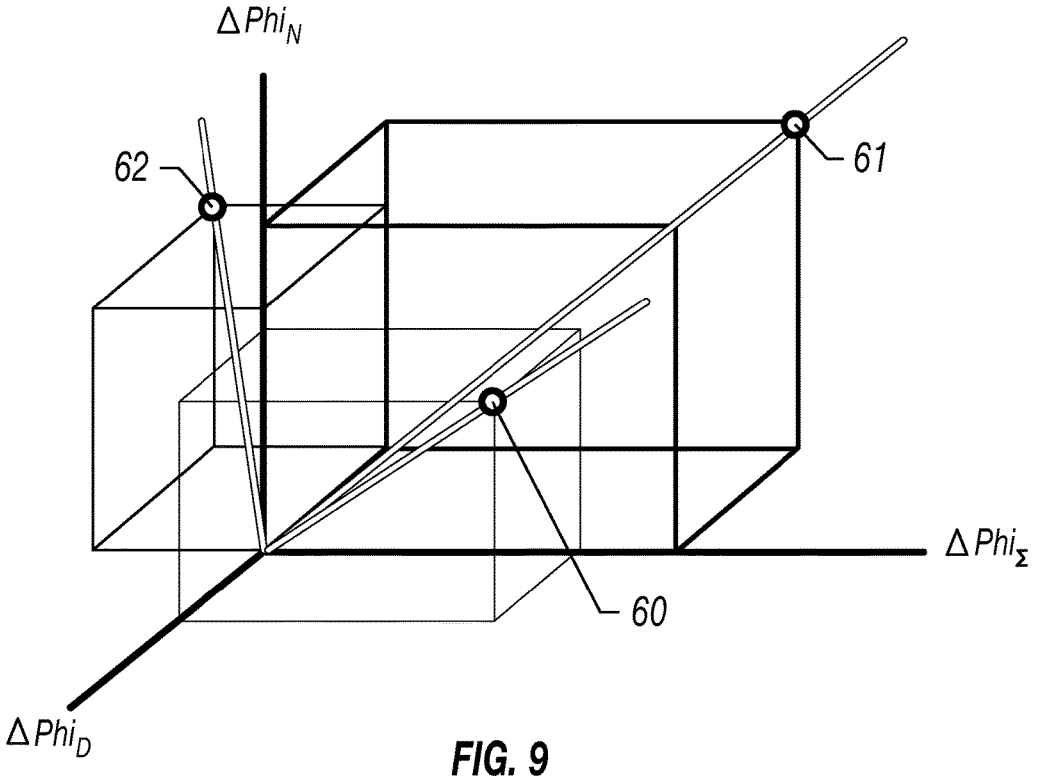

Turning to FIGS. 6-8, these are similar to FIG. 4 and display relationships corresponding to three different fluid substitution patterns (mud filtrate replacing Fld-A represented by point 60, mud filtrate replacing Fld-B represented by point 61, and mud filtrate replacing Fld-C represented by point 62), and in the instance where $\vec{M}$ represents the three log measurements $Phi_N$ (apparent neutron porosity), $Phi_D$ (apparent density porosity), and $Phi_\Sigma$ (apparent Σ porosity). FIG. 9 shows all three of the different fluid substitution signature points 60-62 displayed concurrently on the same graph.

This result means that datapoints corresponding to the same "I" and "J" pair exchange will be aligned along the vector $(\vec{M}_I-\vec{M}_J)$, and vice versa. Clusters of datapoints along these vectors then identify which pair of formation constituents "I" and "J" have substituted each other in-between the snapshots "i" and "j". To effectively distinguish these clusters in practice, one approach is to consider datapoint histograms per solid angle in "n-dimension" space, or to normalize the datapoint vectors $\Delta_{ij}(\vec{M})$ to be of amplitude one (i.e. to project them, against an n-dimensional sphere of radius one) according to:

$$\frac{\Delta_{ij}(\vec{M})}{\|\Delta_{ij}(\vec{M})\|}$$

for those datapoint vectors above a preset noise threshold $\|\Delta_{ij}(\vec{M})\| >> \eta$, and where the norm $\|\Delta_{ij}(\vec{M})\|$ may be defined in a number of ways. This pseudo-normalization expressly unveils some of the x-constituent substitution patterns present, where the substitution has resulted in noticeable differences in-between the different formation snapshots. Neural network techniques, factor analysis, and/or other statistical analysis techniques may then be used to automatically zone the formation according to the patterns acknowledged.

In the special case of underground formations with variable water salinity, this typically results from water injection operations to maintain reservoir pressure and sustain hydrocarbon production where the injected water salinity differs substantially from the original formation water (i.e., connate water) salinity. The mixture of the two in different proportions across the reservoir results in different water salinity. Once the signature of connate formation water, injection water, and native formation hydrocarbon have been identified and/or extracted, then one is able to convert log measurement differences between drill and wipe passes into corresponding proportions of connate formation water, injection water, and native formation hydrocarbons present within that volume of formation fluids displaced by mud filtrate.

The displaced fluid composition arrived at in this manner is referred to herein as a "pseudo-composition". This pseudo-composition honors each fluid constituent individually, i.e., when only one fluid has been displaced then the pseudo-composition would only point to that constituent alone, and when one fluid has not been displaced then the pseudo-composition would instead indicate the absence of such constituent. However, the pseudo-composition is non-linear and would not honor exactly the in-between multi-fluid mixtures. The pseudo-composition itself may be carried out in a variety of ways, depending on the pseudo-normalization used. One way may be to derive composition data by locating the fluid signature inside the geodesic triangle described below, supported by the displayed signatures (i.e., the vertices SIG-I, SIG-II, and SIG-III).

One consideration of pseudo-normalization is that clusters of datapoints from different x-constituent substitution patterns cannot be distinguished from each other once normalized, in those instances where the corresponding vectors are parallel to each other. Furthermore, clusters of datapoints gathered around the origin "O" and corresponding to a pair of x-constituents with similar properties (such as native formation oil being displaced by oil base mud filtrate, or native formation water being displaced by water base mud filtrate), may not be distinguished conclusively from other clusters of datapoints corresponding to other x-constituent pair exchanges, and may not make the cut when retaining only those datapoint vectors $\Delta_{ij}(\vec{M})$ above a preset noise threshold $\|\Delta_{ij}(\vec{M})\| >> \eta$.

Figure 10:
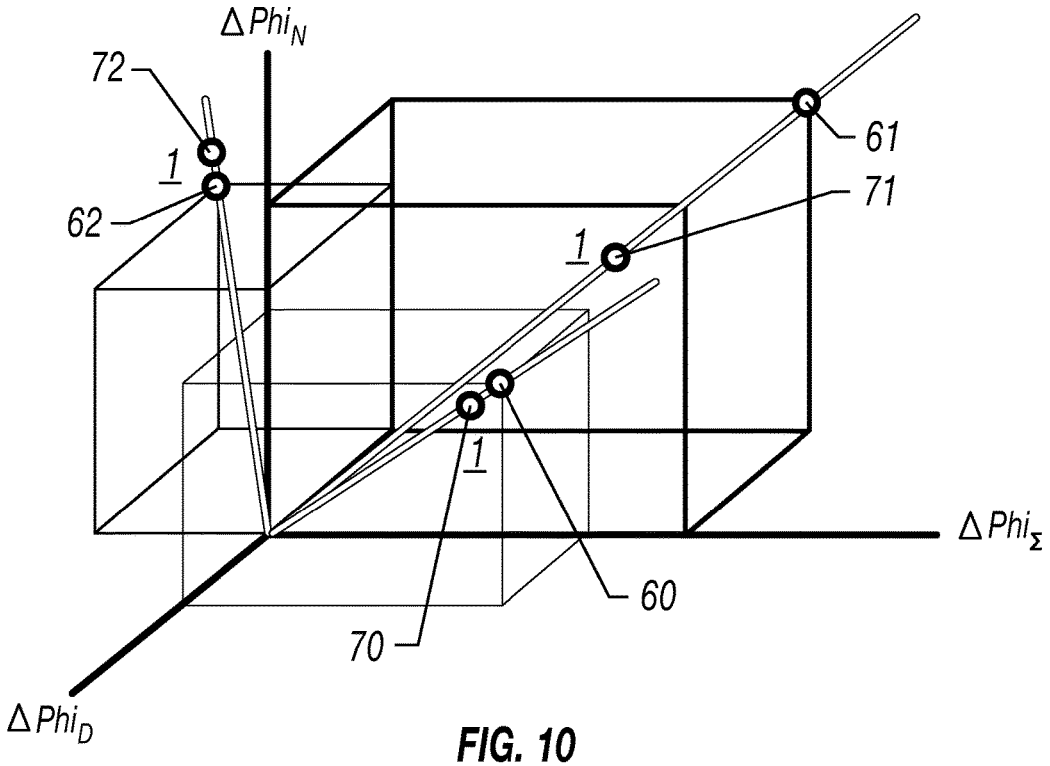
FIG. 10 is a 3D graph showing the fluid displacement signatures of FIG. 9 normalized to a uniform length.
Figure 11:
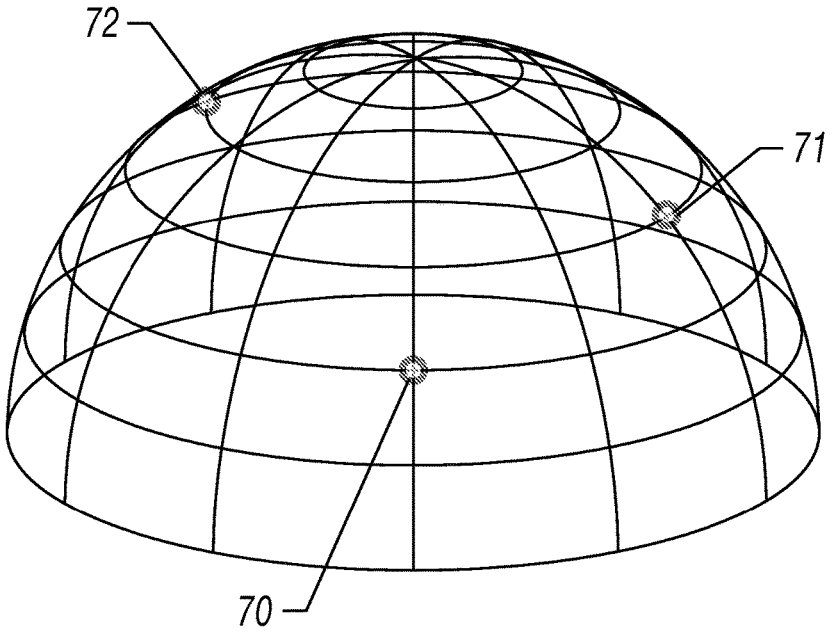
FIGS. 11 and 12 are schematic 3D diagrams showing the normalized signature points from FIG. 10 projected on an imaginary sphere, and a resulting geodesic triangle connecting the points, respectively.

Referring to FIG. 10, here the three different lines and fluid substitution signature points 60-62 shown in FIG. 9 are again displayed, but also respective normalized points 70-72 along these lines located at a distance equal to one (i.e., the intersection of these lines with and/or the projections of the datapoints onto the sphere of radius equal to one). Because of the one-to-one correspondence between the lines shown, and the corresponding intersection with the sphere of radius one, reference to the different fluid substitution signatures will be construed to mean the corresponding points 70-72 located on the sphere of radius one. In FIG. 11, only the sphere of radius one discussed above and the normalized points 70-72 are shown (i.e., the corresponding lines have been removed, which may be regarded as redundant information at this point).

Figure 12:
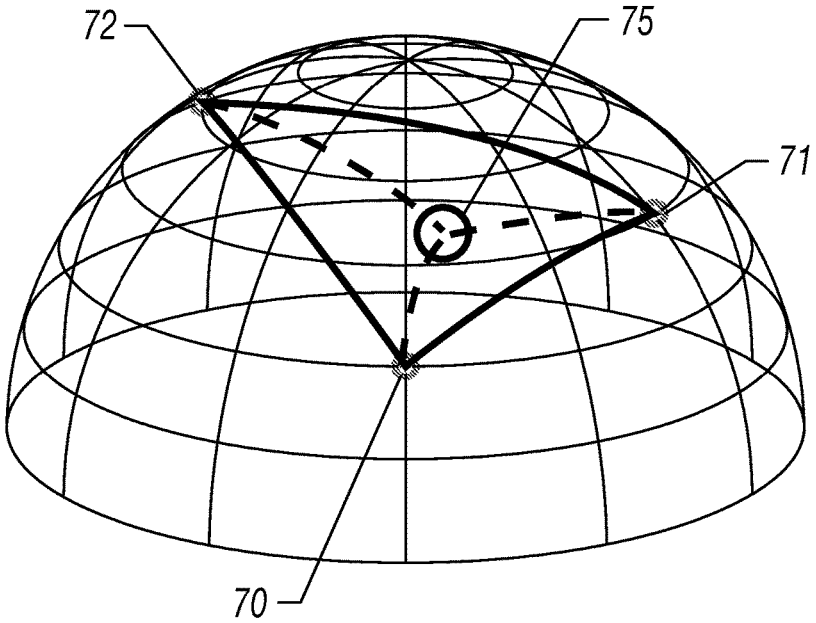

In FIG. 12, a geodesic triangle joining the different signatures points, or vertices 70-72 is shown. Any point 75 contained within this triangular area would actually correspond to the signature of mud filtrate Fld-X substituting a mixture of Fld-A, Fld-B, and Fld-C in different proportions, according to the ratio of the "solid angle" (or area) sustained by the point and the two opposite vertices respectively, to the solid angle sustained by all three vertices 70-72.

Figure 13:
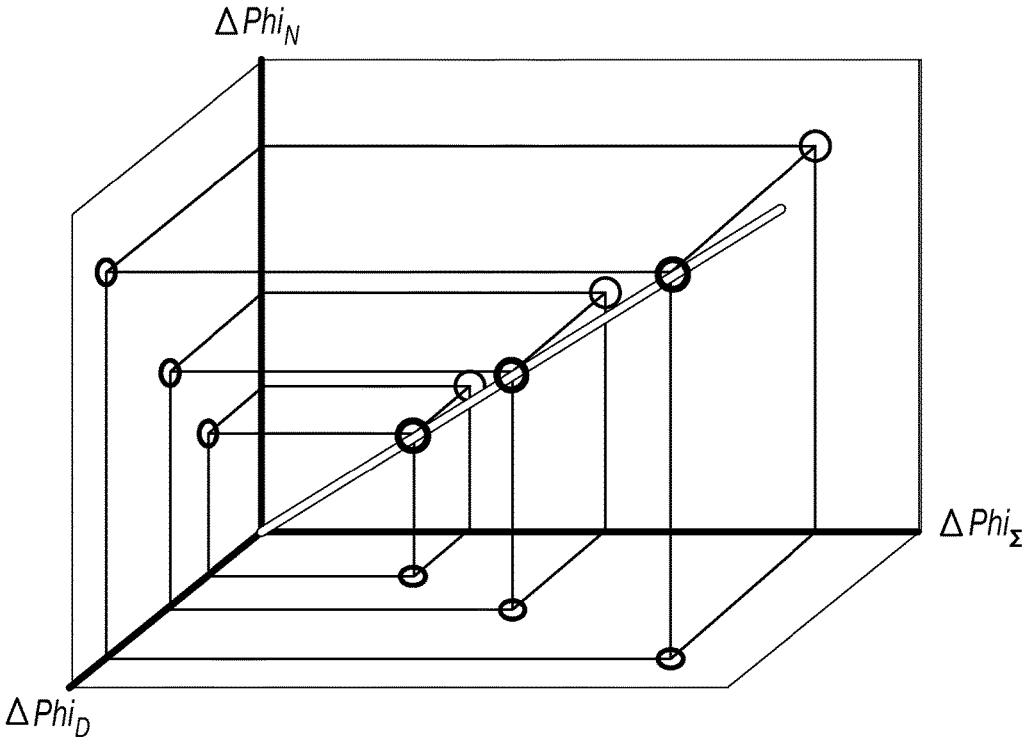
FIGS. 13 and 14 are 3D graphs showing data points corresponding to a single pair of constituents substituting one another through fluid displacement identical to FIG. 4, but with corresponding projections of these points and normalized fluid signatures resulting therefore, on horizontal (X,Y), vertical front-facing (Y,Z), and vertical left-facing (ZX) planes respectively.
Figure 14:
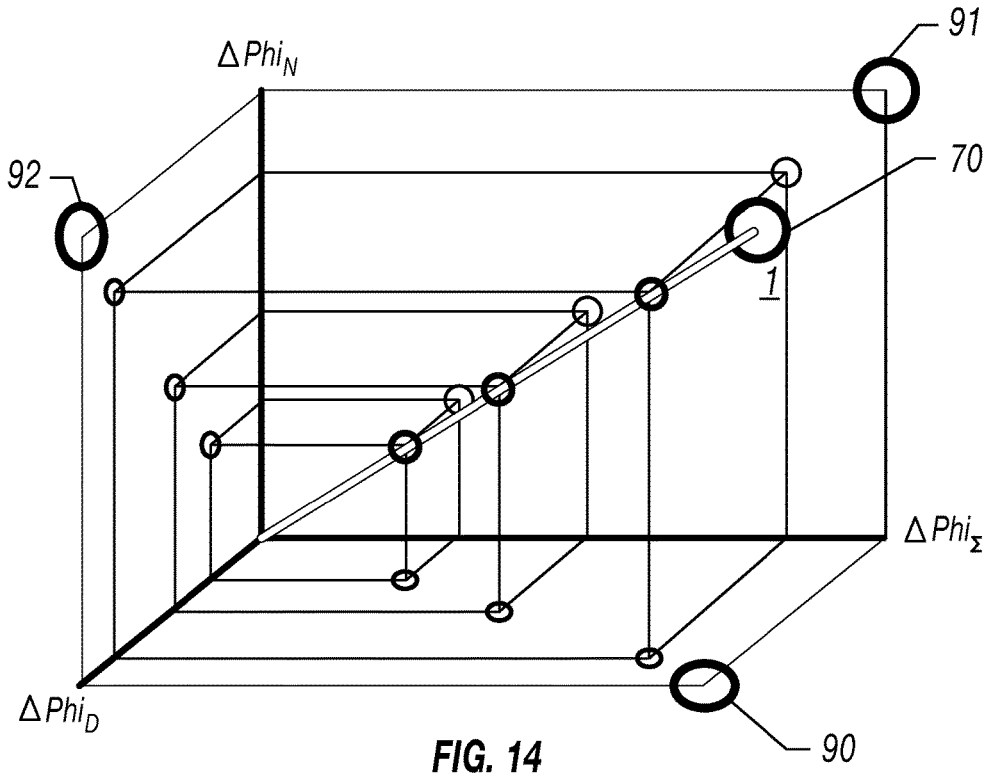

Referring additionally to FIGS. 13-17, a process of converting data points in three-dimensional (3D) space into a corresponding representation in two-dimensional (2D) space is illustrated, in which case a single point in 3D space may instead be represented as a triangle in 2D space. With respect to FIG. 13, this shows the same line and datapoints corresponding to the single fluid substitution signature displayed in FIG. 4, but now with an added projection of these datapoints on each of the three planes XY (horizontal plane), YZ (vertical front-facing plane), and ZX (vertical left-facing plane). In FIG. 14, this view is like FIG. 13 but now including also the fluid substitution signature point 70 located on the sphere of radius one, and the corresponding projections 90-92 on each of the three planes XY, YZ, and ZX as discussed above.

Figure 15:
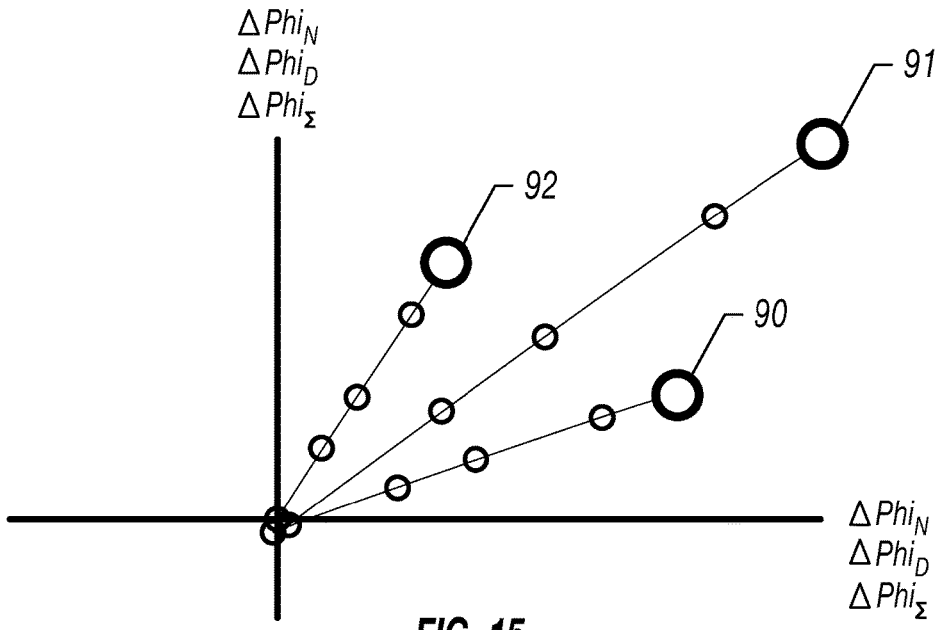
FIGS. 15-17 are two-dimensional (2D) graphs illustrating another approach to plotting the signature points from FIG. 12.
Figure 16:
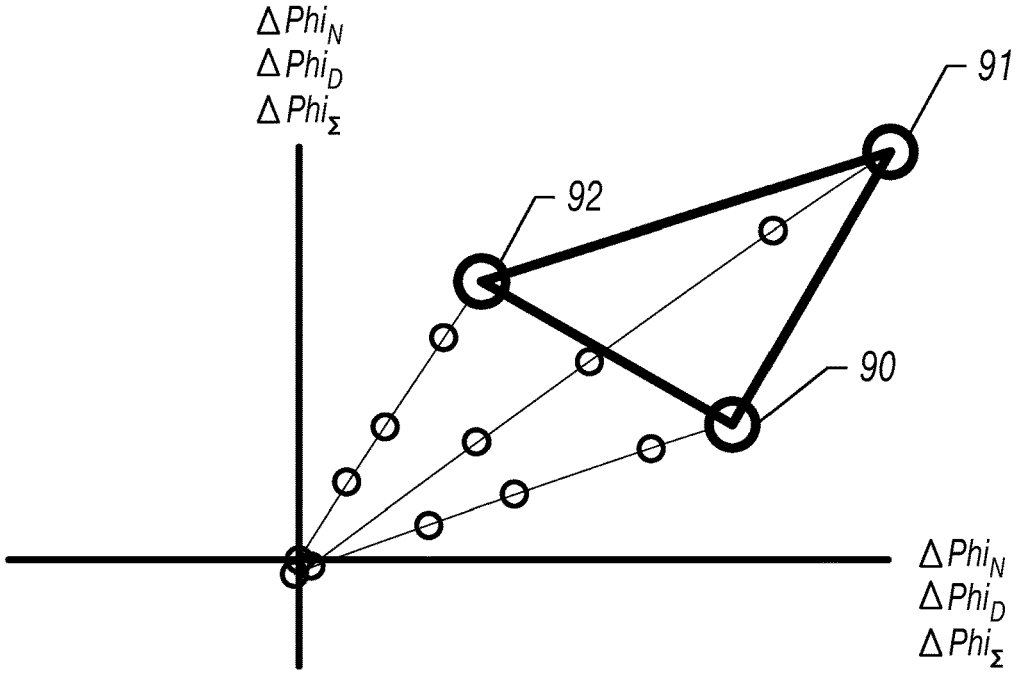
Figure 17:
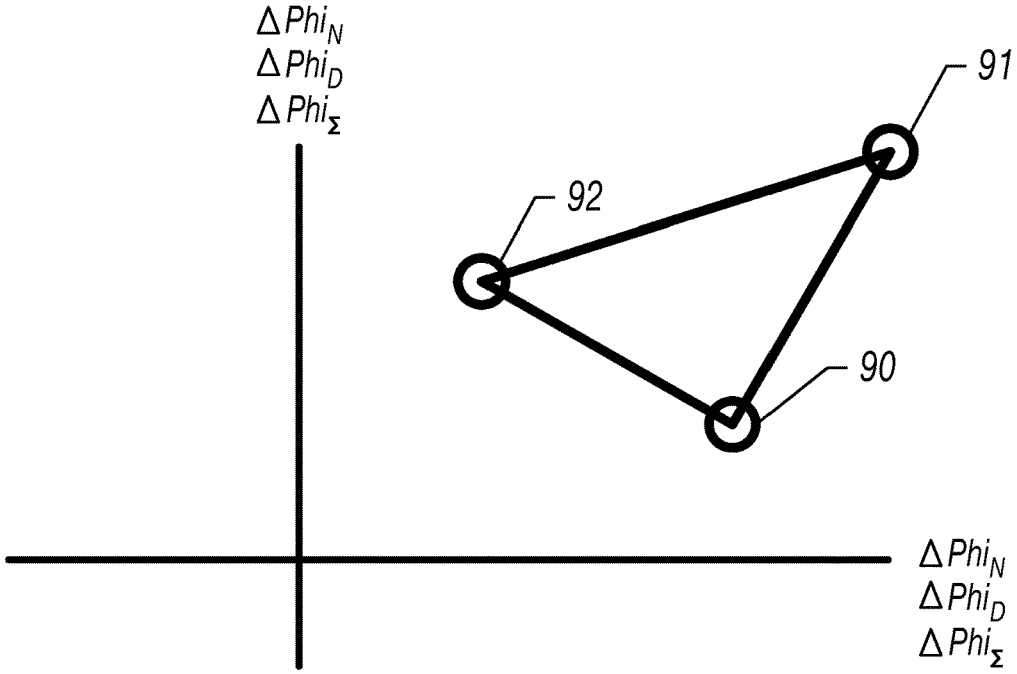

In FIG. 15, the 3D display from FIGS. 13 and 14 are replaced with a 2D display by superimposing the different 2D projections from the planes XY, YZ, and ZX on top of each other. In FIG. 16, lines forming a triangle and joining the different projections 90-92 of the single fluid substitution signature point 70 is shown. Thus, the 3D data points from the differential dataset may be represented instead as a corresponding triangle in 2D, as shown in FIG. 17.

With regard to the process of going from a 3D display to a 2D display, where fluid substitution signatures are represented instead in 2D by a triangle instead of a 3D point, this 2D display may be more convenient to work with in some embodiments. This may be the case when working with more than three log measurements (i.e., more than three dimensions) in which case an N-dimensional fluid substitution signature may optionally be converted into a 2D signature, represented by an "N×(N−1)/2" polygon.

Figure 3A:
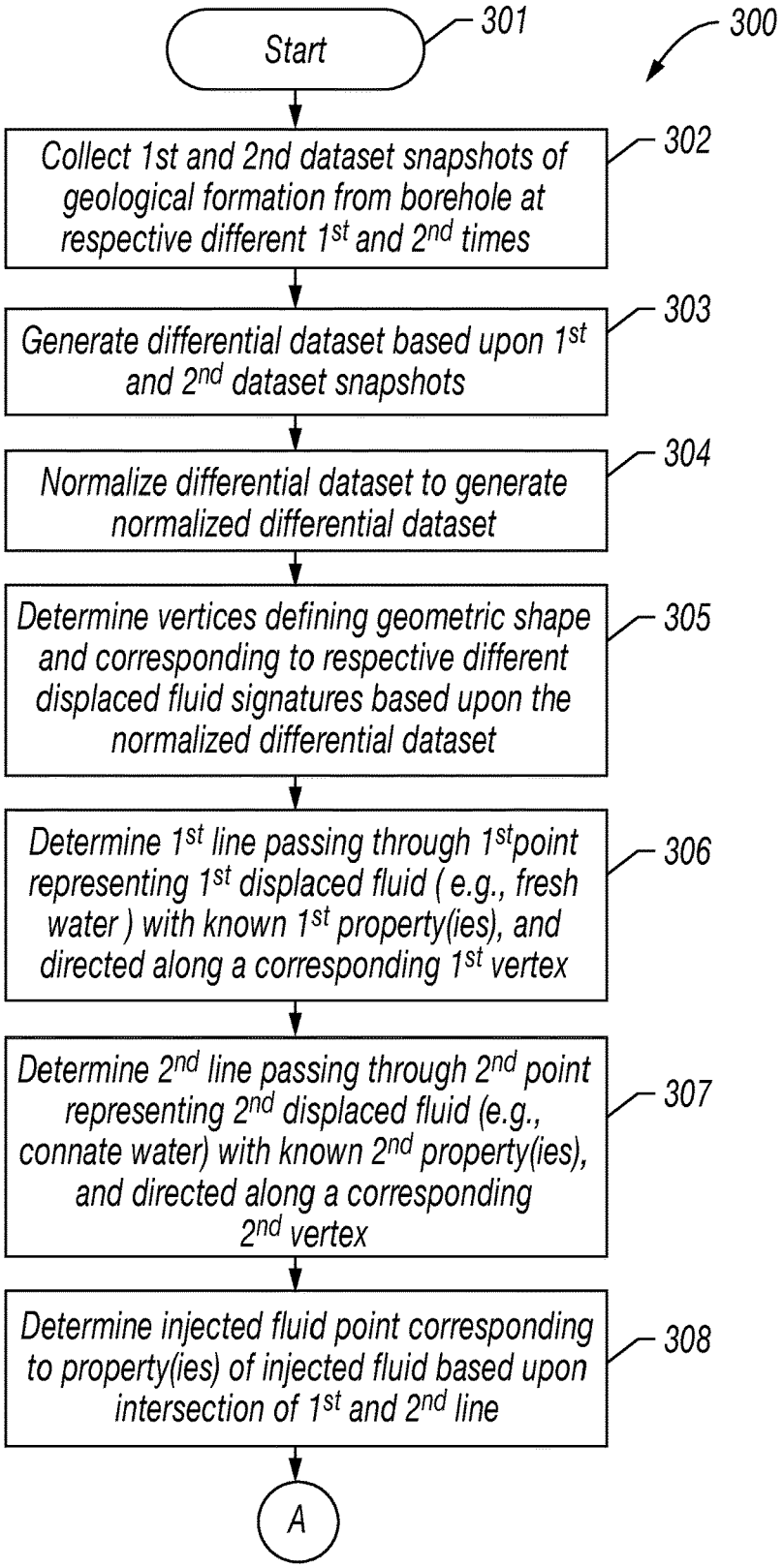
Figure 3B:
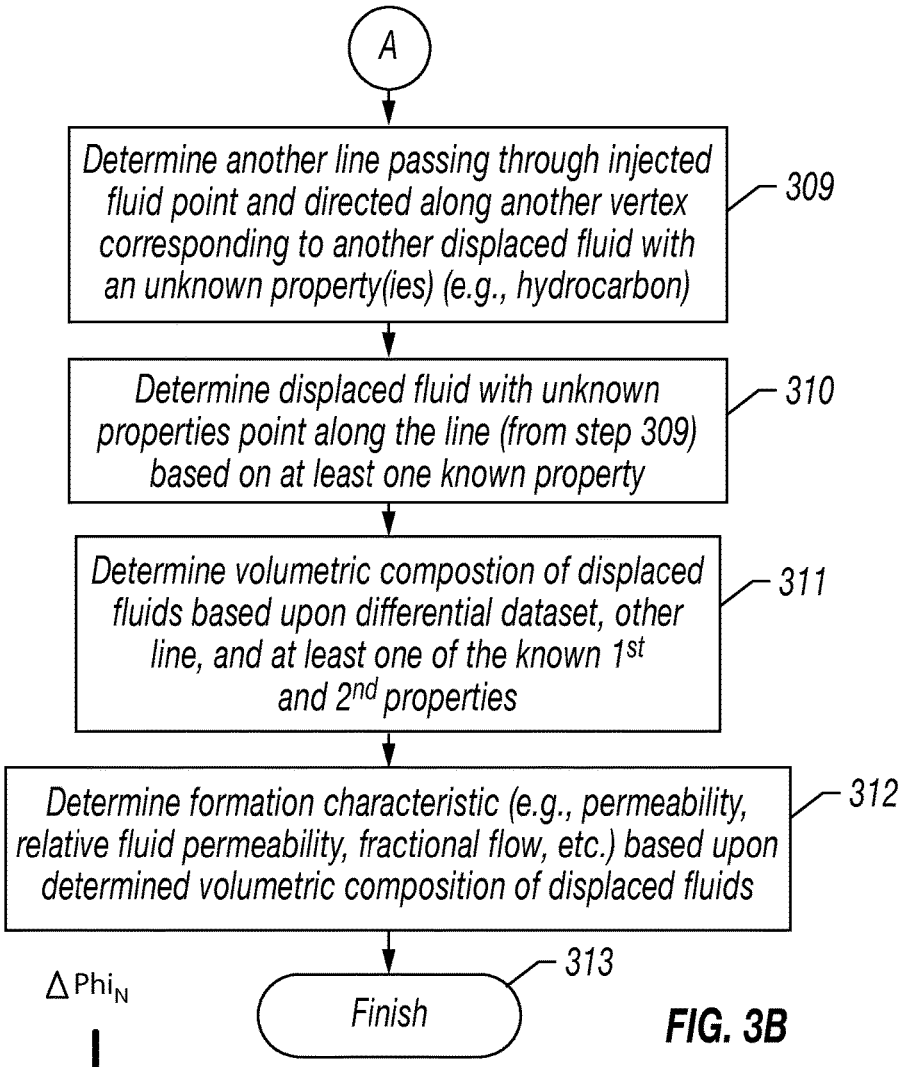

Referring now additionally to the flow diagram 300 of FIG. 3 (FIG. 3A), in some implementations it may be desirable to also consider both the displaced fluids true composition and the volume of mud filtrate that has invaded the formation, by locating data points from the differential dataset inside the tetrahedron supported by the origin "O" and points 60-62 on FIG. 9-10, provided points 60-62 can also be accurately identified, and not just points 70-72 which were the focus of pseudo-normalization discussed above. This is made possible in the case of variable formation water salinity, for example, because water is a well known fluid. Beginning at Block 301, first and second dataset snapshots of the geological formation (e.g., drill and wipe snapshots) are collected from the borehole 11 at respective different first and second times, with the borehole subject to fluid injection between the first and second times to displace fluids in the geological formation adjacent the borehole, at Block 302. As similarly discussed above, a differential dataset is generated based upon the first and second dataset snapshots (Block 303), the differential dataset is normalized to generate a normalized differential dataset (Block 304), and vertices defining a geometric shape and corresponding to respective different displaced fluid signatures are determined based upon the normalized differential dataset, at Block 305.

Figure 18:
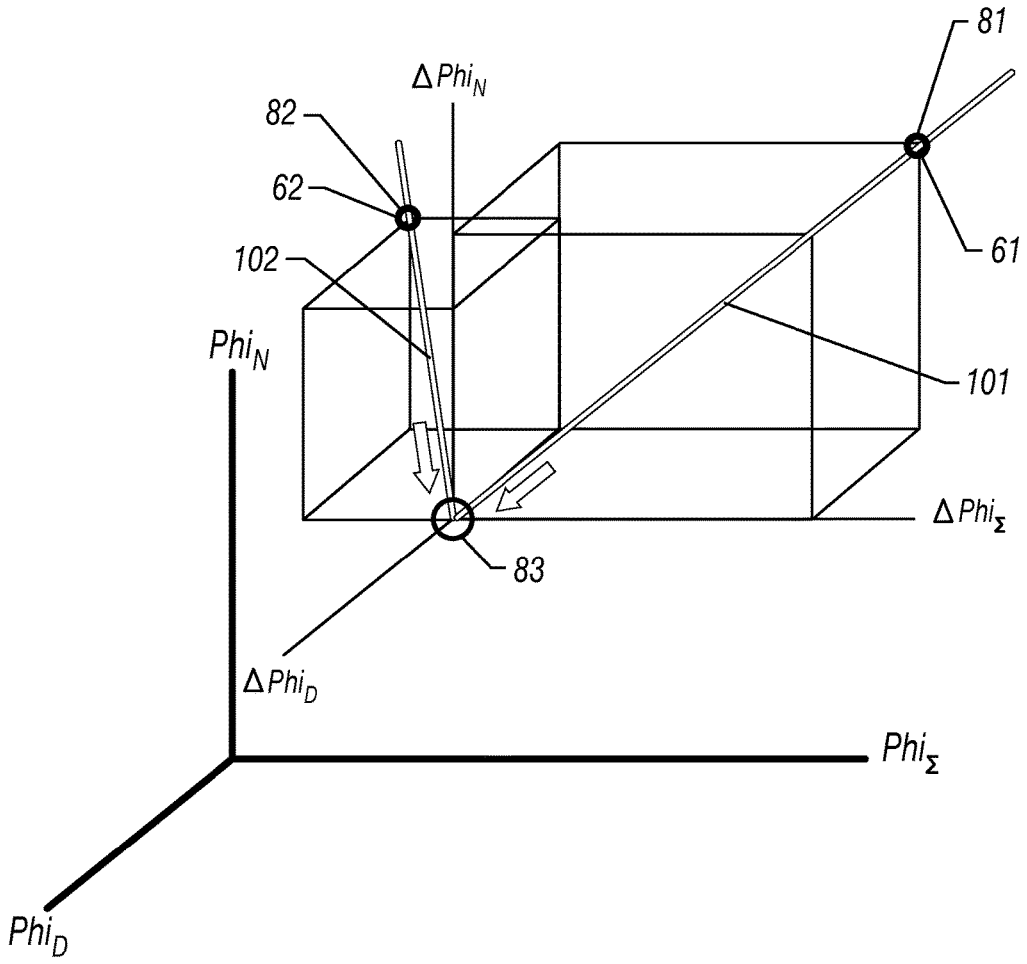
FIGS. 18 and 19 are 3D graphs illustrating an approach for determining drilling mud filtrate and native formation hydrocarbon signatures in accordance with an example embodiment.
Figure 19:
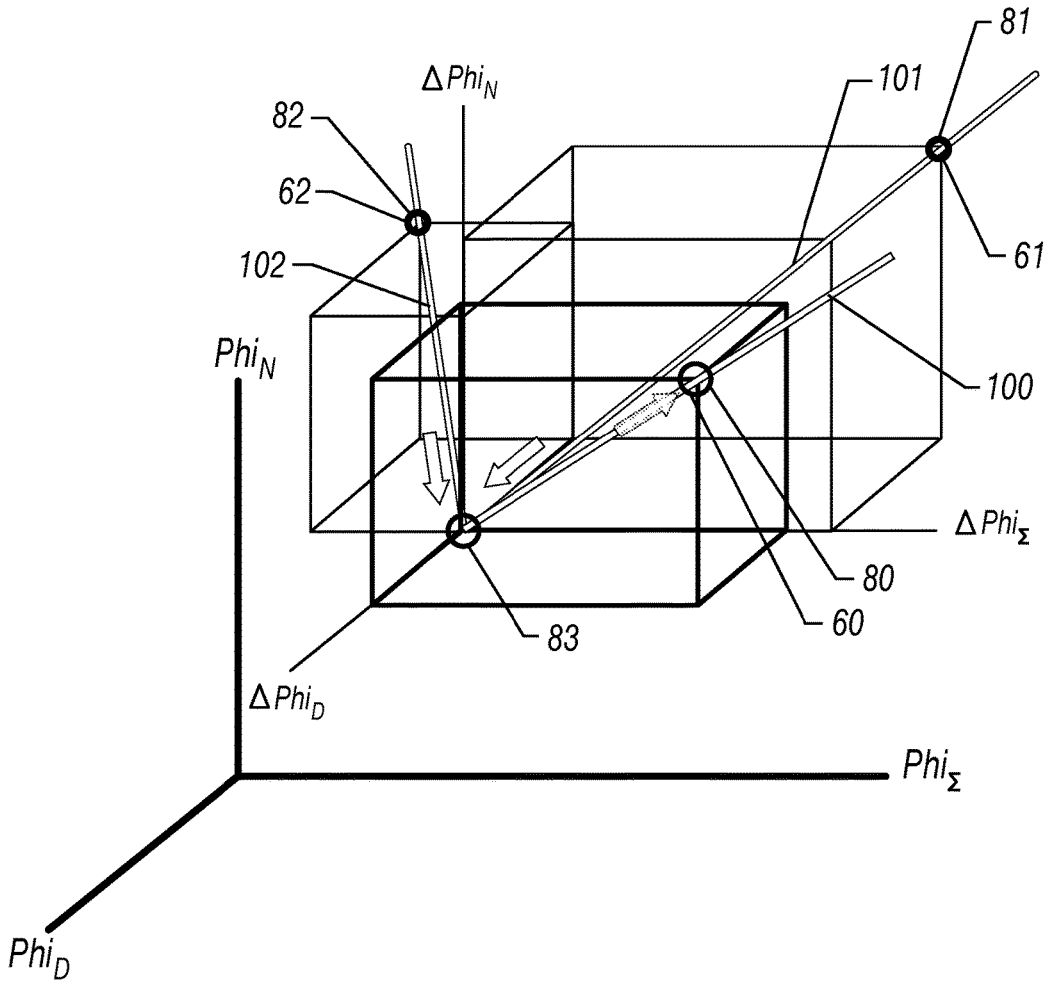

Referring additionally to FIGS. 18-19, new points 80-82 are introduced and collocated respectively with points 60-62, to distinguish between points 60-62 with coordinates in the differential dataset referential (shown with the 3 axis labeled $\Delta Phi_D$, $\Delta Phi_N$, and $\Delta Phi_\Sigma$), and points 80-82 with coordinates in the first and second measurements dataset snapshots absolute referential (shown with the 3 axis labeled $Phi_D$, $Phi_N$, and $Phi_\Sigma$). This distinction is not required in the case of vectors (and vertices) because vectors would retain the same coordinates in both referentials. Also introduced is point 83 at the origin of the differential dataset referential, and points 80-83 coordinates represent respectively the properties of all fluids present, native formation fluids Fld-A (e.g., formation oil), Fld-B (e.g., saline connate water), Fld-C (e.g., fresh injection water), and drilling mud filtrate fluid Fld-X.

In addition to the differential dataset referential used in FIGS. 6-17 (shown with the 3 axis labeled $\Delta Phi_D$, $\Delta Phi_N$, and $\Delta Phi_\Sigma$), the first and second dataset snapshots absolute referential is also shown (shown with the 3 axis labeled $Phi_D$, $Phi_N$, and $Phi_\Sigma$) in FIGS. 18 and 19. Various data points shown as circles will have different coordinates, depending on the differential or absolute referential considered, whereas vectors would retain the same coordinates in both referentials.

In the illustrated example a first line 101 is determined passing through a first point 81 representing a first displaced fluid with known first properties (e.g., Fld-B), and directed along a corresponding first vertex (e.g., Sig-II), at Block 306. Furthermore, a second line 102 is determined passing through a second point 82 representing a second displaced fluid with known second properties (e.g., Fld-C), and directed along a corresponding second vertex (e.g., Sig-III), at Block 307. An injected fluid point 83 corresponding to a property of the injected fluid (e.g., Fld-X) is determined based upon an intersection of the first line 101 and the second line 102, at Block 308. Another line 100 is determined passing through the injected fluid point 83 and directed along another vertex e.g., Sig-I) corresponding to another displaced fluid with an unknown properties (e.g., Fld-A), at Block 309. The displaced fluid with unknown properties point 80 may then be determined along line 100, based on at least one property of the displaced fluid (e.g., density, or API gravity), at Block 310. This allows a volumetric composition of the displaced fluids to be determined based upon the differential dataset, and points 80-83, at Block 311. In some embodiments, formation or reservoir characteristics (e.g., permeability, relative fluid permeability, fractional flow, etc., may also be determined based upon the determined volumetric composition of the displaced fluids, at Block 312, which illustratively concludes the method of FIG. 3 (Block 313—FIG. 3B).

More particularly, with the salinity of connate formation water (e.g., Fld-B) and injection water (e.g., Fld-C) in hand, the corresponding log measurements responses 81 and 82 may be computed. Moreover, with the help of the two vectors corresponding to the signature of x-constituent substitution with mud filtrate (e.g., Sig-II and Sig-III) derived through time-lapse data acquisition as described earlier, we now have two lines 101, 102 in 3D space. These two lines intersect each other at the signature point 83 of the mud filtrate (although two lines do not necessarily intersect in 3D space, an error minimizing function may be selected to locate the most appropriate point to call the intersection, as will be appreciated by those skilled in the art). With the help of the mud filtrate signature 83, and the vector (e.g., Sig-I) corresponding to native formation hydrocarbon (e.g. Fld-A) substitution with mud filtrate derived also through the same time-lapse data acquisition mentioned above, we now have one line 100 in 3D space on which the native formation hydrocarbon signature point 80 lies. Therefore, if we just know one of the exact native formation hydrocarbon properties (e.g., density because that hydrocarbon parameter is typically well known), then the other properties follow accordingly. As noted above, FIG. 18 illustrates how to arrive at the mud filtrate signature (e.g., fld-X), while FIG. 19 shows how to arrive at the native formation hydrocarbon signature (e.g., Fld-A). That is, FIGS. 18-19 illustrate how to arrive at the true x-constituent substitution signatures in the example case of variable formation water salinity, where the displaced fluids consist of a mixture of three fluids, native formation hydrocarbon(s) (Fld-A), connate formation water (Fld-B), and injection water (Fld-C).

Once $(\vec{M}_{Connate_water}-\vec{M}_{Mud_filtrateJ})$, $(\vec{M}_{Injected_water}-\vec{M}_{Mud_filtrateJ})$, and, $(\vec{M}_{Oil}-\vec{M}_{Mud_filtrateJ})$ have all been estimated reliably, then we may compute both the displaced fluids true composition and the volume of mud filtrate that has invaded the formation from the equation $\Delta_{ij}(\vec{M})=\Delta_{ij}(V_{Connate_water})\cdot(\vec{M}_{Connate_water}-\vec{M}_{Mud_filtrateJ})+\Delta_{ij}(V_{Injected_water})\cdot(\vec{M}_{Injected_water}-\vec{M}_{Mud_filtrateJ})+\Delta_{ij}(V_{Oil})\cdot(\vec{M}_{Oil}-\vec{M}_{Mud_filtrateJ})$.

An application to underground formations with variable water salinity will now be discussed, which typically results from water injection operations to maintain reservoir pressure and sustain hydrocarbon production where the injected water salinity differs substantially from the original formation water (i.e., connate water) salinity, and the mixture of the two in different proportions across the reservoir results in different water salinity. Using the above-described approach, we now show how to identify and/or assign the different fluid x-constituent substitution signatures corresponding to connate formation water, injection water, and native formation hydrocarbon(s), and then to continuously interpret (along the well) the log measurement differences resulting from mud filtrate invasion as a mixture of connate formation water, injection water, and unswept hydrocarbons of different proportions. The resulting fluid proportions were benchmarked and validated against another existing technique, namely using simultaneously resistivity and Σ measurements, to solve for both water salinity and water volume present in the pores.

By way of contrast, the present approach focuses on studying the composition of the fluid mixture displaced by mud filtrate (i.e., what will flow), whereas the resistivity and Σ technique focuses on the water present inside the pores (and not necessarily displaced). Furthermore, the present approach uses measurements with linear mixing laws, whereas the resistivity and E technique uses non-linear resistivity mixing laws, which moreover require the usage and/or tuning of resistivity equation parameters, such as the so-called Archie's "M and N" parameters. In addition, the present approach does not use any matrix parameters, because the matrix contributions to the input cancel out when taking the difference between the drill and wipe passes, whereas the resistivity and Σ technique requires accounting for clay, etc., volume corrections and using the appropriate matrix Σ.

Moreover, the present approach uses two passes (e.g., drill and wipe passes), whereas the resistivity and Σ technique is based upon a single pass. Also, the present achieves resolution when there is contrast between the fluid displaced and mud filtrate, or when there is a difference between the properties of the displaced fluids, whereas the resistivity and Σ technique loses resolution where water salinity is low. Further, the x-constituent substitution signatures discussed in the present approach may change from well-to-well in tandem with the drilling mud used to drill the wells, or may be absent or difficult to identify such as when all the moveable hydrocarbons have already been swept away, preventing the determination of the native formation oil signature. However, in the present approach, factor analysis and/or other statistical analysis techniques may make it straightforward to extract the new signatures despite changes in the drilling mud system. It should be noted that results using the present approach and from the resistivity and Σ technique were determined and validated against results from fluid samples analysis.

An example interpretation workflow based upon the above-described approach is as follows:

1. Acquire a drill pass;
2. Acquire a wipe pass;
3. Compute a formation parameter from the drill pass, such as fluid-independent apparent porosity in accordance with one example;
4. Compute the same formation parameter from the wipe pass;
5. Compare the same parameter from both drill and the wipe pass for the purpose of depth-matching the wipe pass to the drill pass;
6. Re-compute the same formation parameters from both drill and wipe pass after the depth-matching exercise carried out above to provide a satisfactory determination that the drill and wipe passes are on-depth with respect to each other;
7. Compute a matrix-corrected true porosity (as opposed to the fluid-independent apparent porosity) described above;
8. Carry out vertical resolution matching on the inputs that are required to carry out the simultaneous inversion of resistivity and Σ log measurements (the inputs being resistivity, Σ, and true porosity);
9. Carry out the simultaneous inversion of resistivity and Σ log measurements (draft results as satisfactory);
10. Use the draft results to identify zones where mud filtrate is most likely to displace connate formation water only, injection water only, or native formation hydrocarbon(s) only;
11. Average the effectively consonant log measurement inputs, used in this example to carry out the present invention methodology, over a sliding window (e.g., 10 ft window, i.e., over 21 datapoints at a sampling rate of two datapoints per foot) to average out statistical noise and further diminish the impact of any residual depth mismatch between drill and wipe passes before subtracting them from each other, and attenuate any residual measurements axial resolution mismatch. The log measurement inputs in the example embodiment were apparent density porosity, apparent neutron porosity, and apparent Σ porosity;
12. Subtract the drill and wipe passes from each other;
13. Zone the resulting differential dataset, according to the "zones" identified in step 10, and/or use factor analysis and/or other statistical analysis techniques to assign the individual fluid substitution signatures corresponding to connate formation water, injection water, and native formation hydrocarbon(s);
14. Interpret continuously along the well, the log measurement differences, as a mixture of connate formation water, injection water, and unswept hydrocarbon(s) in different proportions;
15. Reduce the 10 ft. averaging interval mentioned in step 11 to improve the vertical resolution of the output results while monitoring the trade off between improved vertical resolution and increased statistical noise;
16. Compare the results from this approach against the results from simultaneous inversion of resistivity and Σ log measurements, if desired, while keeping in mind that the former is focused on studying the composition of the fluid mixture displaced by mud filtrate (i.e., moveable fluids), whereas the latter is focused on studying the water vs. hydrocarbons in place (i.e., occupying the entire pore space).

Overall, the test results compared favorably with those from the resistivity and Σ technique, as computed water salinity figures were in agreement. It was also observed that the displaced fluid composition appears to indicate a predominantly "binary system" only. That is, the displaced fluid composition was either a mixture of connate water and injection water only, or a mixture of injection water and native formation oil only, or a mixture of native formation oil+connate water only.

Many modifications and other embodiments will come to the mind of one skilled in the art having the benefit of the teachings presented in the foregoing descriptions and the associated drawings. Therefore, it is understood that various modifications and embodiments are intended to be included within the scope of the appended claims.

That which is claimed is:

1. A method for determining volumetric data for fluids within a geological formation having a borehole therein, the method comprising:

deploying at least one logging tool in the borehole, the at least one logging tool including at least one of an electromagnetic logging tool, an acoustic logging tool, a nuclear magnetic resonance logging tool, and a nuclear logging tool;

causing the at least one logging tool to make a first set of measurements including first, second, and third logging measurements of the geological formation at a first time;

causing the at least one logging tool to make a second set of measurements including first, second, and third logging measurements of the geological formation at a second time, wherein the borehole is subject to fluid injection between the first and second times in which mud filtrate displaces first, second, and third fluids to form first, second, and third displaced fluids in the geological formation adjacent the borehole;

computing a difference between the first, second, and third logging measurements in the first set of measurements and the corresponding first, second, and third logging measurements in the second set of measurements to generate a differential dataset including first, second, and third differential measurements;

normalizing the differential dataset to generate a normalized differential dataset including first, second and third normalized differential measurements;

determining a coordinate system having first, second, and third axes representing the first, second, and third logging measurements;

determining first, second, and third vertices in the coordinate system defining a geometric shape and corresponding to displaced fluid signatures for the first, second, and third displaced fluids based upon the first, second, and third normalized differential measurements;

determining a first point in the coordinate system representing a set of known first properties for the first displaced fluid and a first line passing through the first point and directed along a corresponding first vertex;

determining a second point in the coordinate system representing a set of known second properties for the second displaced fluid and a second line passing through the second point and directed along a corresponding second vertex;

determining an injected fluid point corresponding to a set of properties of an injected fluid based upon an intersection of the first line and the second line;

determining a third line passing through the injected fluid point, and directed along a third vertex corresponding to the third displaced fluid with at least one unknown property;

determining a third point along the third line based upon at least one known property of the third displaced fluid; and determining a volumetric composition of the first, second, and third displaced fluids based upon the first, second, and third differential measurements, the first point, the second point, and the third point.

2. The method of claim 1 wherein:

the at least one logging tool comprises at least one logging while drilling tool deployed in a drill string;

the first set of logging measurements are made during a drill pass in the borehole; and the second set of logging measurements are made during a wipe pass i-sin the borehole.

3. The method of claim 1 wherein the at least one logging tool comprises a nuclear logging tool and the first set of logging measurements and the second set of logging measurements comprise at least one of gamma ray measurement data, neutron measurement data, density measurement data, and thermal neutron capture cross-section data.

4. The method of claim 1 wherein normalizing comprises normalizing data points from the differential dataset to coincide with the surface of a sphere.

5. The method of claim 1 wherein normalizing comprises normalizing data points from the differential dataset to coincide with the surface of a two-dimensional plane.

6. The method of claim 1 wherein at least one of the known first and second properties comprises a salinity level.

7. The method of claim 1 wherein the third displaced fluid with the at least one unknown properties comprises a hydrocarbon fluid.

8. The method of claim 1 wherein the first displaced fluid comprises connate water.

9. The method of claim 1 further comprising determining at least one of a permeability, a relative fluid permeability, and a fractional flow based upon the determined volumetric composition of the first, second, and third displaced fluids.

10. A well-logging system comprising:

a well-logging tool deployed in a borehole, the well logging tool being one of an electromagnetic logging tool, an acoustic logging tool, a nuclear magnetic resonance logging tool, and a nuclear logging tool, the well logging tool configured to make first and second sets of logging measurements of a geological formation at corresponding first and second times, each of the first and second sets of logging measurements including first, second, and third logging measurements, wherein the borehole is subject to fluid injection between the first and second times to form first, second, and third displaced fluids in the geological formation adjacent the borehole; and a processor deployed within the well logging tool and configured to cause the well logging tool to make the first set of logging measurements at the first time;

cause the well logging tool to make the second set of logging measurements at the second time;

compute a difference between the first, second, and third logging measurements in the first set of logging measurements and the corresponding first, second, and third logging measurements in the second set of logging measurements to generate a differential dataset including first, second, and third differential measurements;

normalize the differential dataset to generate a normalized differential dataset including first, second, and third normalized differential measurements, determine a coordinate system having first, second, and third axes representing the first, second, and third logging measurements;

determine first, second, and third vertices in the coordinate system defining a geometric shape and corresponding to displaced fluid signatures for the first, second, and third displaced fluids based upon the first, second, and third normalized differential measurements, determine a first point in the coordinate system representing a set of known first properties for the first displaced fluid and a first line passing through the first point and directed along a corresponding first vertex, determine a second point in the coordinate system representing a set of known second properties for the second displaced fluid and a second line passing through the second point and directed along a corresponding second vertex, determine an injected fluid point corresponding to a set of properties of an injected fluid based upon an intersection of the first line and the second line, determine a third line passing through the injected fluid point, and directed along a third vertex corresponding to the third displaced fluid with at least one unknown property, determine a third point along the third line based upon at least one known property of the third displaced fluid, and determine a volumetric composition of the first, second, and third displaced fluids based upon the first, second, and third differential measurements, the first point, the second point, and the third point.

11. The well-logging system of claim 10 wherein said well-logging tool comprises a logging-while-drilling (LWD) tool configured to make the first sets of logging measurements during a drill pass and the second set of logging measurements during a wipe pass.

12. The well-logging system of claim 10 wherein well logging tool is a nuclear logging tool and the first and second sets of logging measurements comprise at least one of gamma ray measurement data, neutron measurement data, density measurement data, and thermal neutron capture cross-section data.

13. The well-logging system of claim 10 wherein said processor normalizes data points from the differential dataset to coincide with the surface of a sphere.

14. The well-logging system of claim 10 wherein said processor normalizes data points from the differential dataset to coincide with the surface of a two-dimensional plane.

15. The well-logging system of claim 10 wherein at least one of the first and second known properties comprises a salinity level.

* * * * *